US007114882B1

(12) United States Patent
Friedmann

(10) Patent No.: US 7,114,882 B1
(45) Date of Patent: Oct. 3, 2006

(54) AQUA-TERRA PLANETARY TRANSPORT SYSTEM AND DEVELOPMENT PNEUMATIC AND ELECTRO-MAGNETIC UNDERWATER TUBE-LINK TRANSPORTATION SYSTEM

(76) Inventor: Jan Friedmann, 11842 Kiowa Ave, #4, Los Angeles, CA (US) 90049

( * ) Notice: Subject to any disclaimer, the term of this patent is extended or adjusted under 35 U.S.C. 154(b) by 0 days.

(21) Appl. No.: 10/784,427

(22) Filed: Feb. 23, 2004

(51) Int. Cl.
*B63C 11/00* (2006.01)

(52) U.S. Cl. ..... 405/194

(58) Field of Classification Search ..... 405/194, 405/188
See application file for complete search history.

(56) References Cited

U.S. PATENT DOCUMENTS

| | | | | | |
|---|---|---|---|---|---|
| 530,398 | A | * | 12/1894 | Cooper | 405/190 |
| 1,016,808 | A | * | 2/1912 | Williamson | 405/194 |
| 3,708,991 | A | * | 1/1973 | Barkley | 405/194 |
| 3,895,495 | A | * | 7/1975 | Akazaki et al. | 405/200 |
| 4,904,118 | A | * | 2/1990 | Thiemann, III | 405/195.1 |

* cited by examiner

*Primary Examiner*—Sunil Singh
(74) *Attorney, Agent, or Firm*—Michael I Kroll

(57) ABSTRACT

An aqua-terra planetary transport system and development system utilizing a pneumatic and electromagnetic underwater tube link transportation system to move passengers and cargo rapidly between a network of interconnected land based terra station and ocean based aqua stations. The aqua stations are all self-sufficient and derive power from natural resources and have means for agriculture and manufacturing.

8 Claims, 26 Drawing Sheets

FRONT VIEW

REAR VIEW

AQUA-TERRA PLANETARY TRANSPORT SYSTEM AND DEVELOPMENT PNEUMATIC AND ELECTRO-MAGNETIC UNDERWATER TUBE-LINK TRANSPORTATION SYSTEM

BACKGROUND OF THE INVENTION

1. Field of the Invention

The present invention relates generally to transportation systems and, more specifically, to an underwater transportation system that utilizes pneumatic and magnetic principles to propel a cylinder container containing cargo and eventually passengers through a tube-link network located beneath the surface of the ocean. A plurality of sub-surface tube links interconnect a plurality of ocean based aqua stations and land based terra stations. Each aqua station comprises a surface structure that is typically circular in shape with a substantially conical sub-surface base extending downward therefrom with the inferior portion of said sub-surface based anchored to the ocean floor by a platform base and/or retractable anchors, depending on the depth of the water at that location.

The aqua stations are designed to be totally self sufficient although some goods and supplies will be transported in cylinder containers thereto and from terra stations via the sea to land transport tube-links. For security purposes, no sea vessels will be permitted closer than three hundred feet (300') from the perimeter of the aqua stations. Loading and unloading facilities for air and sea vessels are two independent platforms located on either side of the access platform that contains the access conveyor tunnel to the Aqua Station. This is the only alternate way into the Aqua Stations besides the tube-link from Terra Stations.

The present invention utilizes natural resources such as wind, water, and solar energy to generate sufficient power to supply the needs of the aqua station, sub-stations located on the aqua stations, and the transport system. However, the primary power source is the oceanic waterfall system created by a double hull parallel to the subsurface portion of all aqua stations. This double hull surrounds the subsurface portion of each aqua station and is formed by an inverted skirt that moves vertically along the outer body of the aqua stations to permit water to enter when lowered and disallow water from entering when raised.

This oceanic waterfall system is used to turn turbines located in the lower portion of the aqua station and the salt water is also directed to the desalinization facilities to be used as needed. Excess water is discharged through a tube network designed for such purpose. Included are critical infrastructure services such as housing, engineering and utilities, security, desalinization facilities, greenhouse farming, sea farming, educational facilities, garment and other type of manufacturing facilities to name a few.

Recreational facilities are dispersed throughout the aqua station and include, but are not limited to, resort facilities, outdoor and indoor golf courses, sports arenas, recreational parks, sports tracks for runners, walkers, and bicycle riders, and facilities for ice skaters, swimmers, and all other indoor and outdoor sport activities that may be desired.

Defense and security is paramount throughout the entire system with all terra and aqua stations having state of the art detection and intervention systems in place. Satellites monitor the air space, the sub-water transport tube-link network, the aqua stations and the six floating security platforms forming a two mile security ring that surrounds each station. These security platforms contain thereon equipment capable of long and short range radar, sonar, visual, audio, and laser systems to provide multi-layered detection and defense systems for scanning the air and water space within a substantial area proximal to each station to provide adequate response time in the case of an imminent threat. A plurality of defense options are provided for instances when a potential threat is detected, the defense system includes solar powered drone aircraft, sub-surface security/maintenance vehicles, smart torpedo launchers, electronic guidance scrambler and surface to air laser beam devices. Furthermore, a plurality of passive defense options are available including a retractable dome and an emergency retractable sub-surface explosion proof stainless and special alloy composite curtain that may be deployed during an emergency. Facility security is comprehensive throughout the entire network whether ocean or land based and includes specially trained security personnel and cutting edge surveillance, detection, and screening devices.

The present invention seeks to revolutionize the manner in which cargo and people travel by offering a high-speed alternative for long distance destinations. Additionally, the aqua stations are designed with resort qualities for living and/or holiday pleasures. The present invention is also environmentally friendly since it relies on natural resources and not on the burning of fossil fuels and thus being more cost-effective than present day airline and cargo ship users.

The present invention provides the construction of floating and anchored aquatic stations (Aqua Stations) and their related land-based floatable land stations (Terra Stations). The Aqua Stations are to be united/linked by a sub-water tube link system connecting each Stations to each other to form a long distance super speed electromagnetic and pneumatic subsurface transportation system for use in transporting cargo and passengers to distant places in a very short time.

The transport system incorporates cylinder containers that travel within a sub-water tube-link network connecting to a network of Aqua Stations in distant areas. Each Aqua Station shall be approximately seven (7) to ten (10) miles in diameter and located not less than 15.2 miles off shore at all locations.

Each Aqua Station shall be connected to one or more land-based floatable Terra Stations. Each Terra Station is a collection center for cargo and passengers to be boarded onto the cylinder containers for transport out to the Aqua Station for a stay or boarding onto cylinder containers heading to other desired destination.

The Terra Stations are floatable as an additional safety feature of the system to assure survival in case of rising ocean waters and possible deterioration or collapsing coastlines, given that global warming continues and thus, the melting of polar ice caps will cause ocean waters to rise.

Each tube section has a double corrugated wall, is approximately thirty to fifty feet long and fifteen to eighteen feet in diameter. The cylinder containers/capsules are approximately twenty to thirty feet long and twelve to fifteen feet in diameter able to travel through the tube-link network at speeds up to 14,000 mph even though lower speeds of 4–5,000 mph may be desired and sufficient at first.

The Aqua Stations are giant floating islands/mini-cities, connected by a network of specialized tubes. Each Aqua Station is anchored to the bottom of a body of water (i.e. ocean), with a capacity to submerge through a ballast system, if necessary, as is also the case with the self-sufficient and floatable sub-stations of the smaller domed facilities surrounding the central energy core.

These Aqua Stations are self-sufficient in every way and designed to provide all basic human daily and comfort needs. The primary sources of energy include solar, wind, water motion, and perhaps other forms of energy later to be discovered.

Solar energy shall be derived from the use of collectors placed on the top of the central core of the main Aqua Station. Other solar panel locations may also be developed as floating energy barges near each Aqua Station. Wind energy shall be harnessed from giant windmills to be located at strategic locations around the circumference of each Aqua Station.

Water motion energy shall be derived from the use of wave motion technology and oceanic waterfall system that takes advantage of the surrounding body of water. The oceanic waterfall system allows the water to fall into a specialized deep cavity, thus turning turbines on the way to the bottom to create electricity.

Once reaching near the bottom, some of this water is funneled to desalinization units to create usable fresh water while any excess is discharged into the ocean through an internal tube network. Other forms of energy, not yet used, may be available as this project develops over the next several years to include possibly use of safe atomic energy units.

Each Aqua Station shall be accessible through the tube-link network connecting to other Aqua Station and near by Terra Stations. Additionally, Aqua Stations shall be accessible to aircraft and ships. Ships will dock at the shipping slips provided and attached to a landing platform that is connected to a central platform containing the conveyor tunnel leading to the aqua station for boarding and unloading of goods and persons. Vertical landing aircraft shall also have access to the Station via a landing platform that is also attached and anchored to the central platform and conveyor belt system for transport of goods and persons.

Each Aqua Station will contain six (6) self-sufficient satellite dome units that are independently self-sufficient. The Aqua Stations shall provide energy, housing, food, water storage facilities, entertainment and sports complexes for those living on any Aqua Station or those visiting or passing through.

All satellite sub-station units on each Aqua Station are accessible from any other satellite unit via the central elevator system running from the bottom of the Aqua Stations to the top garden level or by the conveyor belt walking system to be located between and connecting sub-station to sub-station or by foot.

Each Aqua Station is controlled through the Central Control Section that is to be located at the garden level, along the perimeter of the central energy core. Engineering shall be responsible to oversee and control the transport system and be responsive to Central Control decisions and instructions.

Central Control shall be responsible for the operations and management of the entire facility, following the guidelines of the Aqua-Terra Holdings, Inc. directorship or an authorized management entity.

2. Description of the Prior Art

There are other transportation systems known in the art. While these transportation systems would be suitable for the purposes for which they were designed, they would not be as suitable for the purposes of the present invention, as hereinafter described.

SUMMARY OF THE PRESENT INVENTION

A primary object of the present invention is to provide a pneumatic and electromagnetic underwater transportation system having a plurality of ocean based and floating aqua stations and land based terra stations that are interconnected by a network of sub-surface tubes through which cylinder containers are propelled using pneumatic and electromagnetic principles to transport cargo and people.

Another object of the present invention is to provide a pneumatic and electromagnetic underwater transportation system that provides a contained environment to travel at very high speeds, much faster than current transport systems provide.

Yet another object of the present invention is to establish, resulting from the underwater transport system, each aqua station as fully self-sufficient and containing a complete infrastructure to provide utilities, food, water, housing, entertainment complexes, healthcare facilities, educational facilities (Pre-School through University), sports, recreational, and resort facilities.

Still another object of the present invention is to provide a pneumatic and electromagnetic underwater transportation system having a comprehensive multi-tiered security and defense network to detect and thwart off potential threats.

Another object of the present invention is to provide a pneumatic and electromagnetic underwater transport system that derives its electrical power from natural resources including wind harvesting, solar and water flow energy sources.

Yet another object of the present invention is to provide a pneumatic and electromagnetic underwater transportation system wherein each aqua station provides for alternative landing platforms for airborne vehicles and platform loading and unloading docs for ocean borne vessels. Both platforms are attached to the conveyor tunnel located between the two floating platforms. Thus, cargo and passengers arriving from either air or sea have access to the aqua station. For security purposes, no vessels are permitted closer than three hundred feet (300') from the perimeter of any aqua station.

Another object of the present invention is to provide the general world public with a safe and super speed planetary transportation system as an alternative to the slower and more hazardous present day systems using ships and aircraft.

Yet another object of the present invention is to provide a super speed transportation system using pneumatic and electromagnetic principals to catapult a cylinder container/capsule, through a tube/pipe-link network, at speeds potentially reaching 14,000 mph. The transport tube/pipe-link network is located below the surface of the ocean or any body of water, connecting each Aqua Station with all the others.

Another object of the present invention is to provide Aqua Station facilities, ultimately twelve (12) interconnected aqua stations worldwide, whereby cargo may be transported to and the general public can travel through, visit, live, or vacation at these off-shore Aqua Station facilities.

Still another object of the present invention is to provide the construction of housing, research, and operational facilities on the Aqua Stations that would include taking full advantage of current and future technological advances in all areas of human interest. In part, a designated area of the housing development on the Aqua Station would be reserved to construct housing consistent with the architecture of the on-shore community thus, retaining and depicting the traditions and art of the people living near the corresponding on-shore Terra Stations.

Still another object of the present invention is to be provide each Aqua Station with anchoring means to the bottom of the body of water and/or sits on a base platform that is connected to the hydraulic retractable stem that permits the entire Aqua Station to submerge if required. Alternatively, specialized retractable anchors may be used when the depth of the ocean is too deep for the base and stem. The Aqua Station submerges using ballast compartments that are located throughout the lower portion of the Aqua Station and in particular, at the bottom of the Aqua Station and near the top and around the circumference of the Aqua Station.

Another object of the present invention is to provide an aqua-terra planetary transport system wherein the energy sources for the transportation system and the Aqua Station community include solar, wind, and water. Solar power shall be derived from sunlight being converted into usable energy. Wind source electricity shall be provided from turbines being turned by giant windmills to be located at strategic points along the circumference of the Aqua Station. Water source electricity shall be provided from wave motion technology and the oceanic waterfall system created for this project. This double wall structure and retractable outer wall allows seawater or any body of water to enter a deep circumference cavity surrounding the entire Aqua Station and thus by this water fall affect, turbines located within the lower portion of the Aqua Station may be turned to ultimately manufacturer electricity.

Another object of the present invention is to provide an aqua-terra planetary transport system comprising a floating Aqua Station that contains several satellite self contained and sufficient domed units that also have the capacity to float if for any reason the main Aqua Station is severely damaged or detached somehow.

Still another object of the present invention is to provide an aqua-terra planetary transport system wherein the satellite units are located above the water surface, surrounded by a garden like setting with running water streams, accessed through a central elevator system and also provide for all basic human needs including housing, food, water, clothing, and entertainment.

Yet another object of the present invention is to provide an aqua-terra planetary transport system Each satellite unit is different than any other satellite unit within the Aqua Station.

Another object of the present invention is to provide an aqua-terra planetary transport system wherein all sub-stations are complimentary to each other and other sub-stations located on other Aqua Stations. All satellite units are self contained and sufficient on a smaller scale than the primary Aqua Station.

Another object of the present invention is to provide an aqua-terra planetary transport system wherein all operations are conducted from the Central Control section located on the top level surrounding the central core of the Aqua Station. Central Control oversees all operations including engineering and utilities maintenance. Engineering and utility maintenance is located under the water surface.

Still yet another object of the present invention is to provide an aqua-terra planetary transport system wherein each offshore Aqua Station is connected to two or more land-based floatable Terra Stations. These Stations are linked by a large diameter tube/pipe-link for the purpose of transporting goods from shore to the Aqua Station. Once reaching the Aqua Station, the goods are loaded onto cylinder containers/capsules, programmed to reach the desired distant Aqua Station destination, and are immediately sent. The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawings in which.

DETAILED DESCRIPTION OF THE PREFERRED EMBODIMENT

The following discussion describes in detail one embodiment of the invention. This discussion should not be construed, however, as limiting the invention to those particular embodiments, practitioners skilled in the art will recognize numerous other embodiments as well. For definition of the complete scope of the invention, the reader is directed to appended claims.

Figure 1:
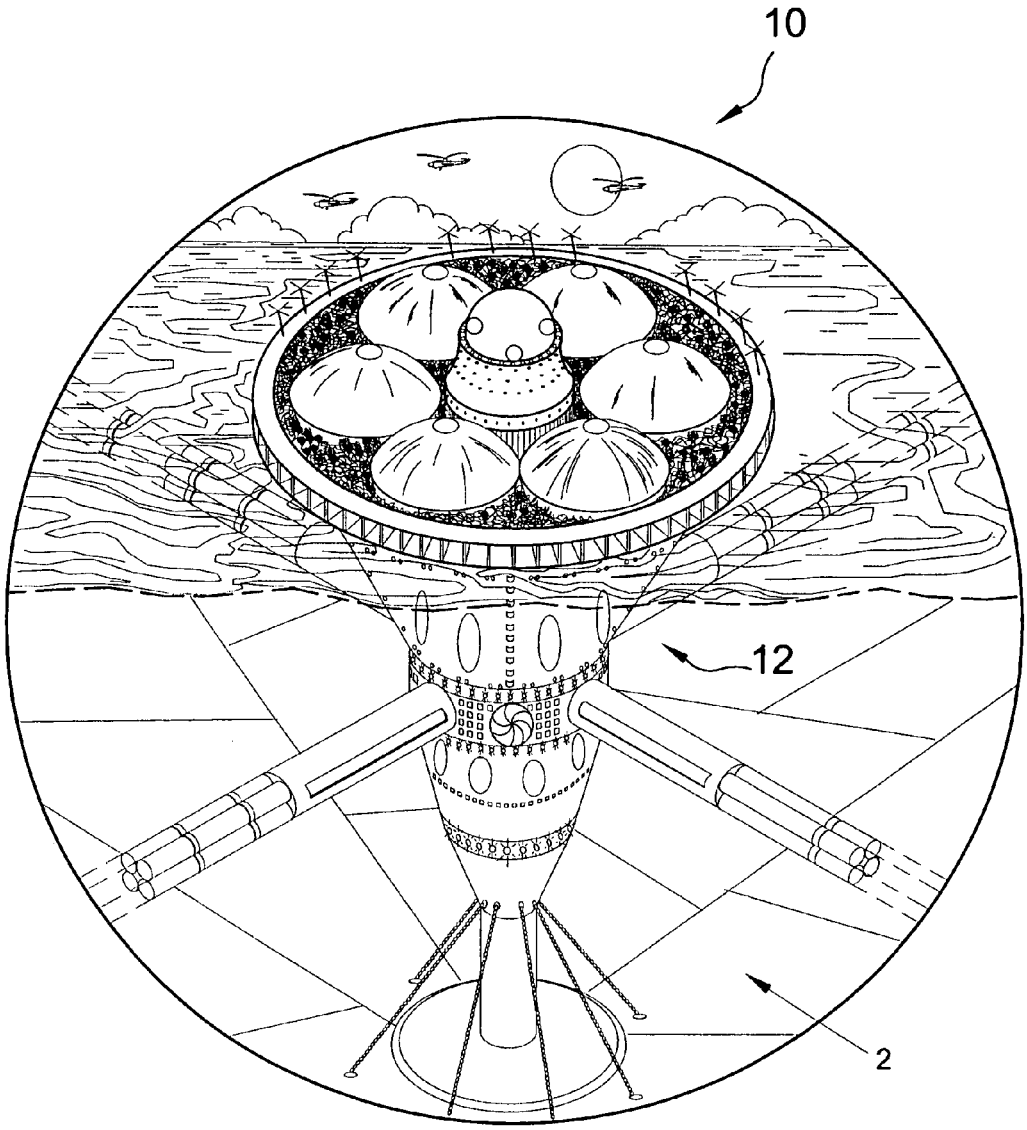
FIG. 1 is a perspective view of the present invention in use.

FIG. 1 is a perspective view of the present invention 10 in use. The present invention is an electromagnetic sub-water transportation system operates through the use of magnetic and pneumatic principles. It propels cylinder containers through a tube link network which is located below the ocean's surface and connected to other aqua stations 12 located in distant areas from each other. Each station will be seven miles in diameter and not less than 15.2 miles offshore at various locations.

Figure 2:
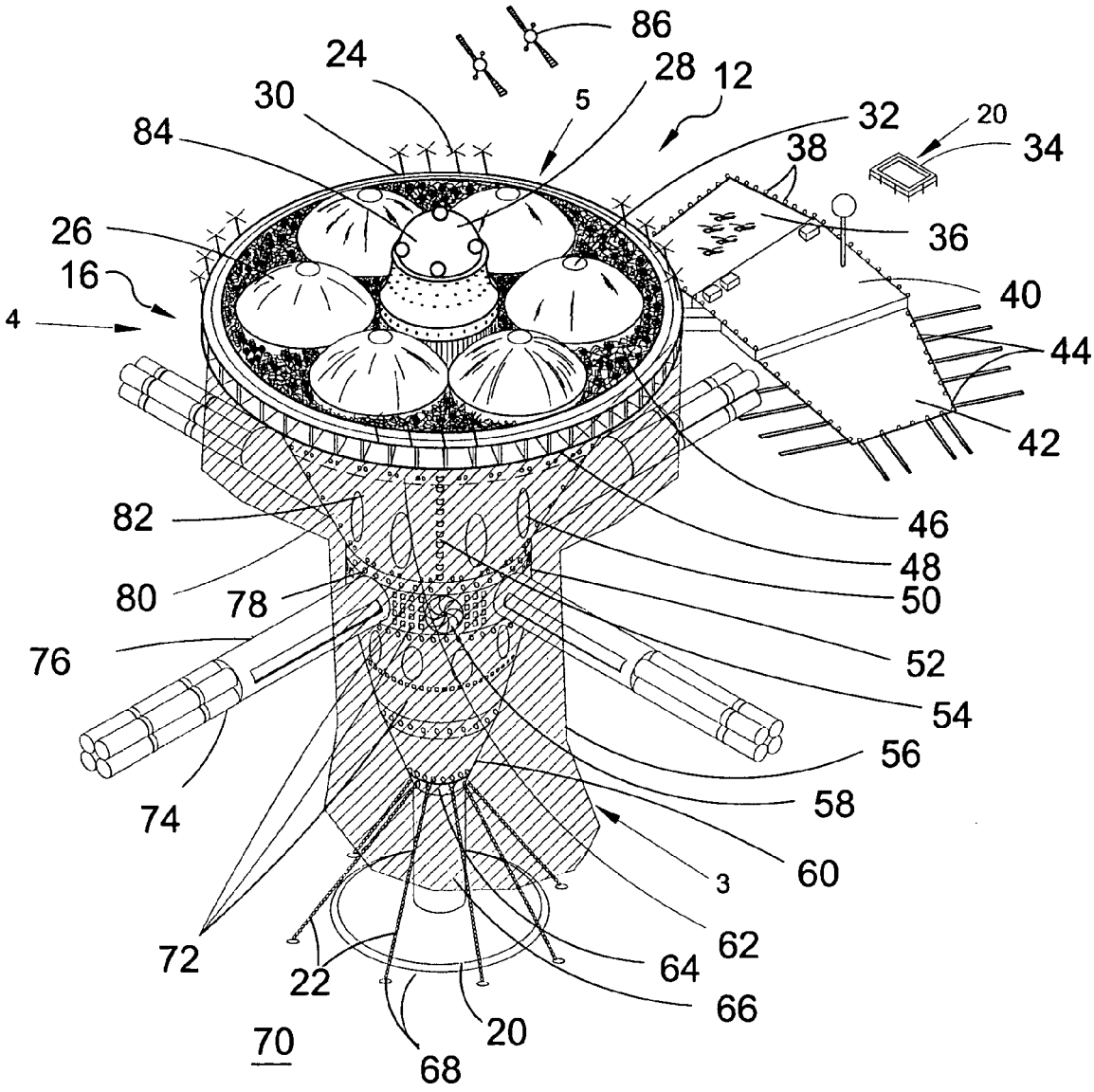
FIG. 2 is a perspective view of the present invention.

FIG. 2 is a perspective view of the present invention 10. Shown is an aqua station 12 of the electromagnetic sub-water transportation system 10 and related components. The aqua station 12 includes a retractable master dome 24 wind energy sources 84, hemispheric satellites 86, a central solar base energy core 28, an alternate solar self-sufficient energy source 32, floating sea farm cages and tanks 34, vertical landing platform for aircraft 36 with lighting 38, a loading and unloading platform and tunnel 40, landing platform and slips for ships 42 with lighting 44, garden and outdoor activities facilities 46, port holes 50, transportation station 52, elevators 54, security curtain 56, transport system extension cavity 58, weight and stabilization chamber 60, ballast compartments 62, detachable section 64, hydraulic stem 66, anchoring means 68 which include a platform base 20 or retractable anchors 22 to secure the aqua station 12 to the ocean floor 70, a storage facility food supplies and engineering and utilities section 72, a transportation tube link network 74, multi-flex tube link section 76, sub-water lighting 78, double wall for waterfall energy source 80, additional housing, entertainment complex and other developments 82, and satellite self-sufficient/floatable sections of station housing/living quarters entertainment/development centers/greenhouse farming in other designated satellite sections all with retractable domes 26.

Figure 3:
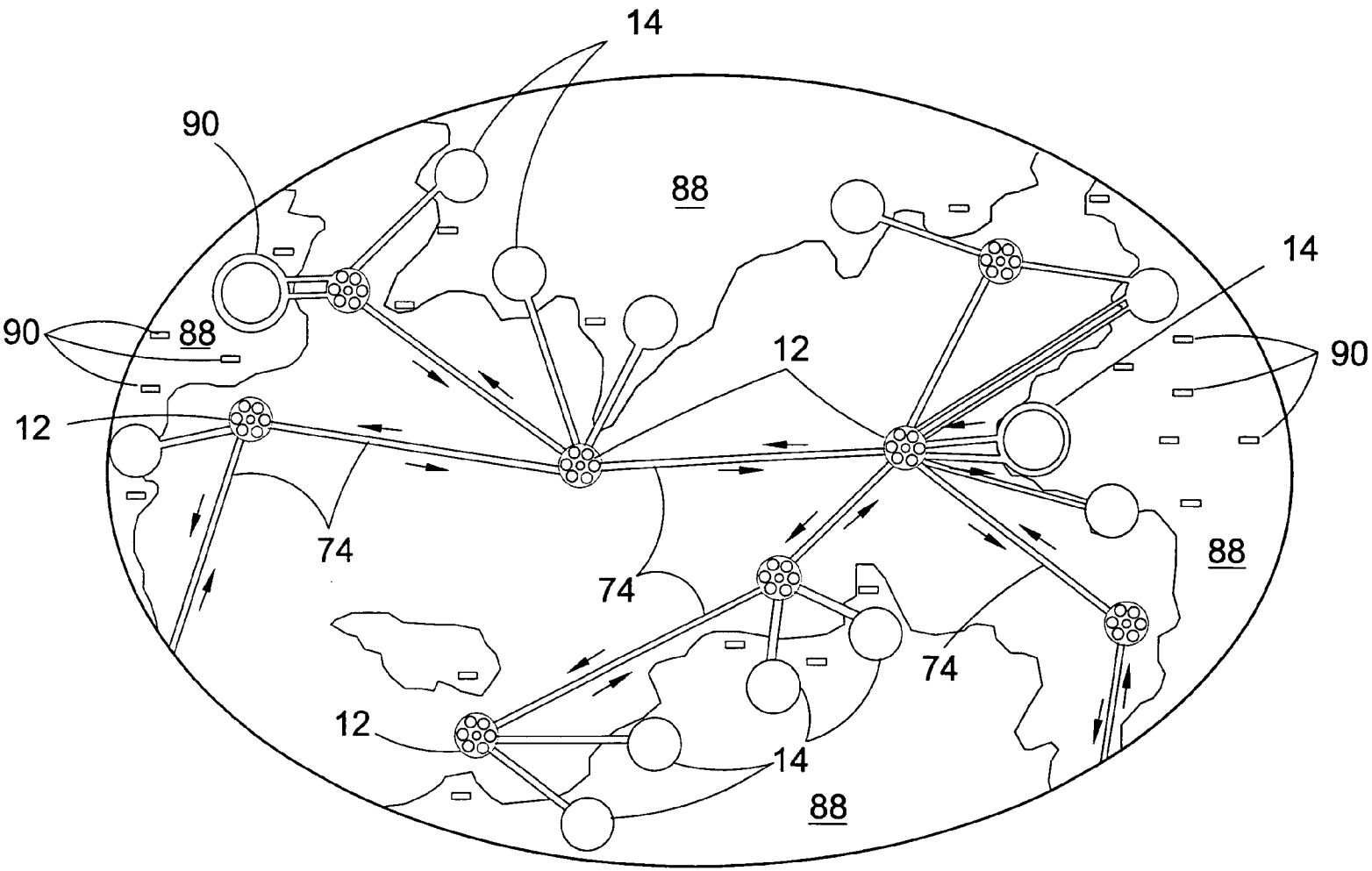
FIG. 3 is a topographical view of the tube link system of the present invention.

FIG. 3 is a topographical view of the tube link system 74 of the present invention 10. Shown is the link between the terra stations 14 on the land 88 near cities 90 and the aqua stations 12 via multi-flex tube link networks 74. Two to four terra stations 14 (in the region) connect to one aqua station 12.

Figure 4:
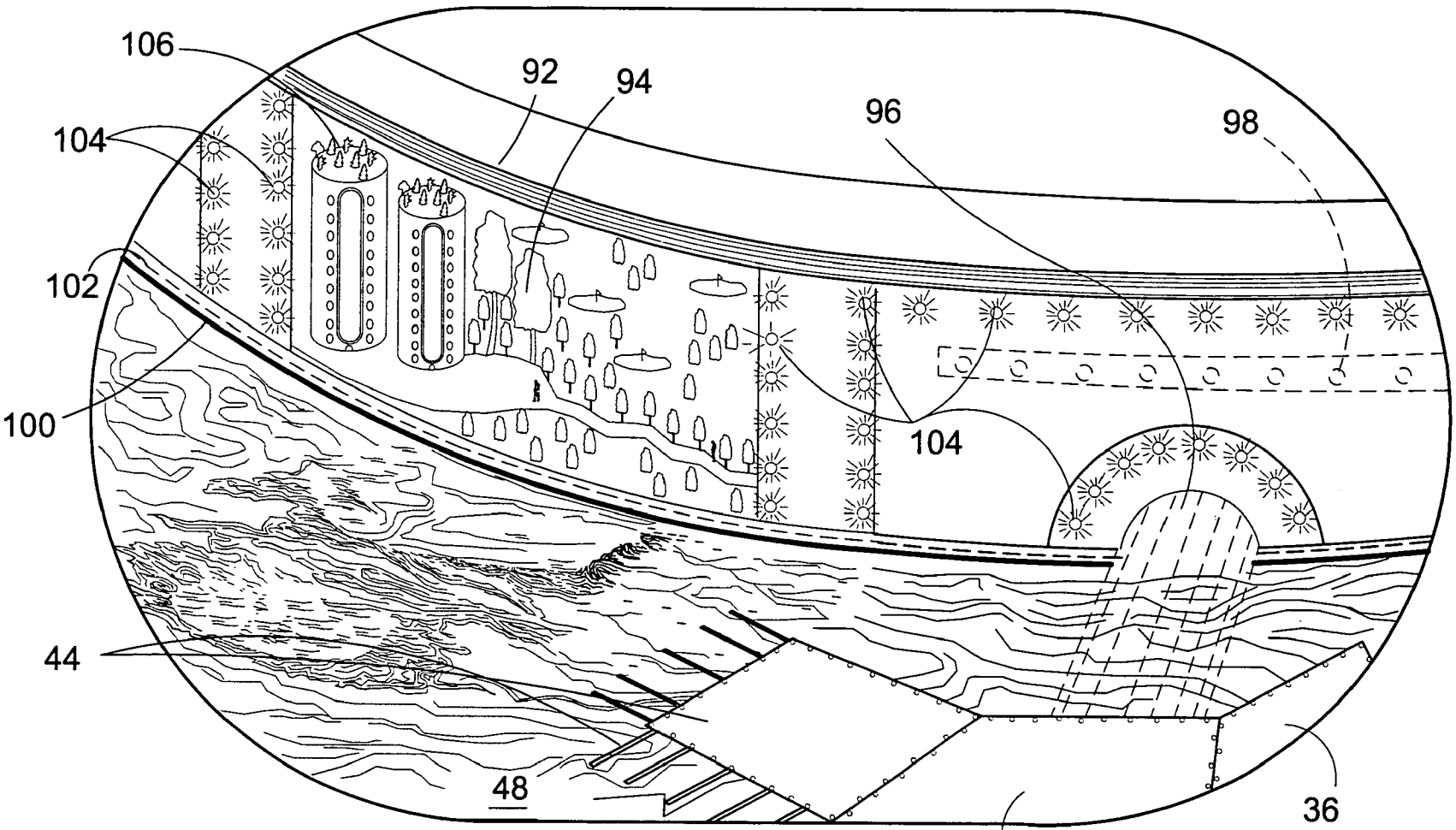
FIG. 4 is a detail view of the vehicle-landing platform.

FIG. 4 is a detail view of the vehicle-landing platform 36. Ships and airborne vehicles gain access to the aqua station 12 by using their appropriate landing platform that connects to the conveyor tunnel platform 96. Also shown are the porthole hotel and resort 106, retractable water-tight upper security curtain 92, resort golf course 94, airborne vehicles landing platform ballast system and anchored 36, platform and tunnel to station 40, automated ships landing platform with slips 44, lower security curtain 100, upper security curtain water tight groove 102 and lights 104.

Figure 5:
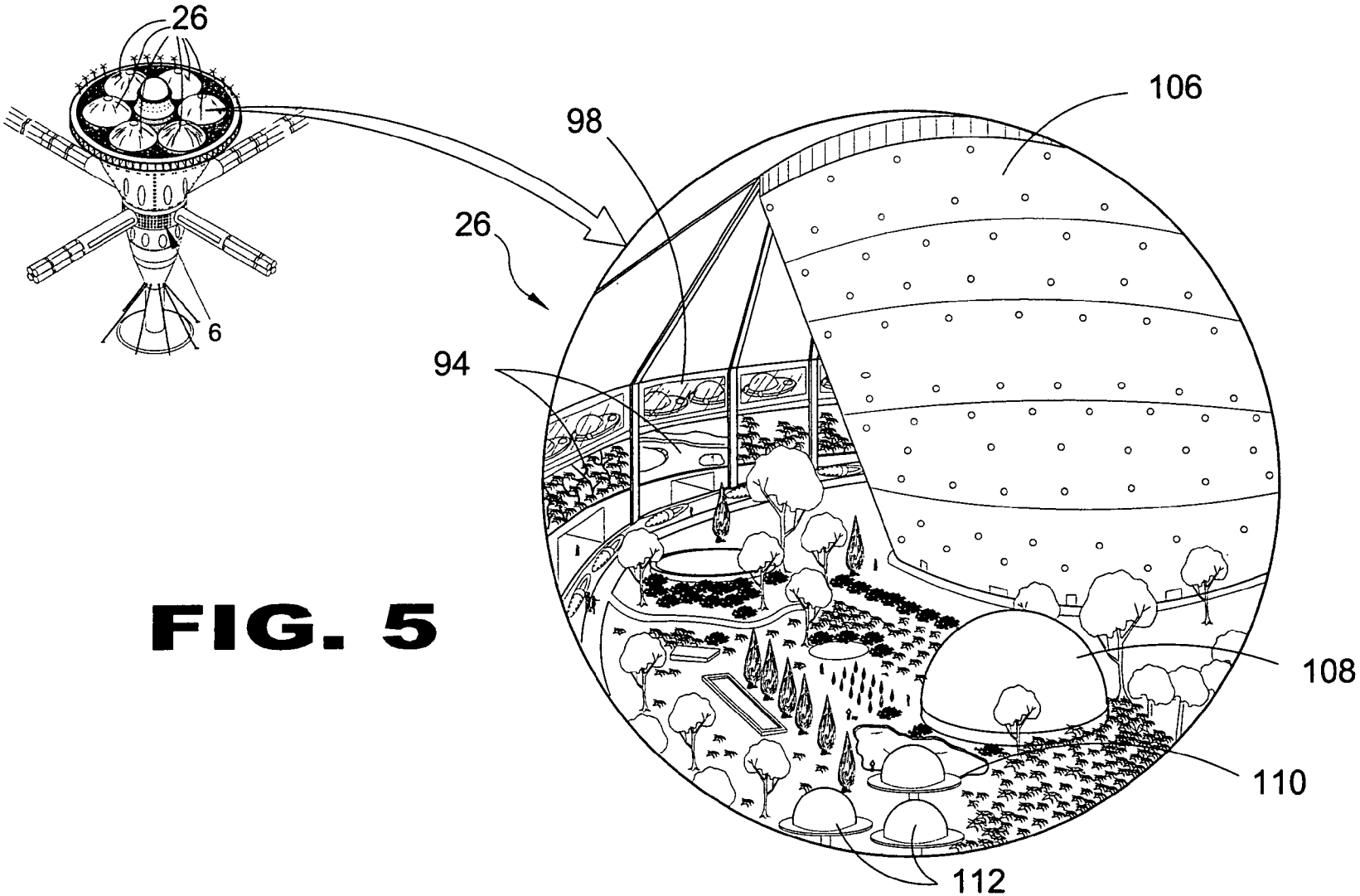
FIG. 5 is a detail view of the interior sub-station dome.

FIG. 5 is a detail view of the interior sub-station dome 26. Shown is a partial view of the garden areas 110, outdoor activities facilities and some housing 112. This level of the dome is above the water line and can be accessed via any level of the aqua station by the central elevator system and circumference transport system to move from substation 26 to substation 26 as desired. The central elevator system links to every level of the station and sub-stations 26.

Figure 6:
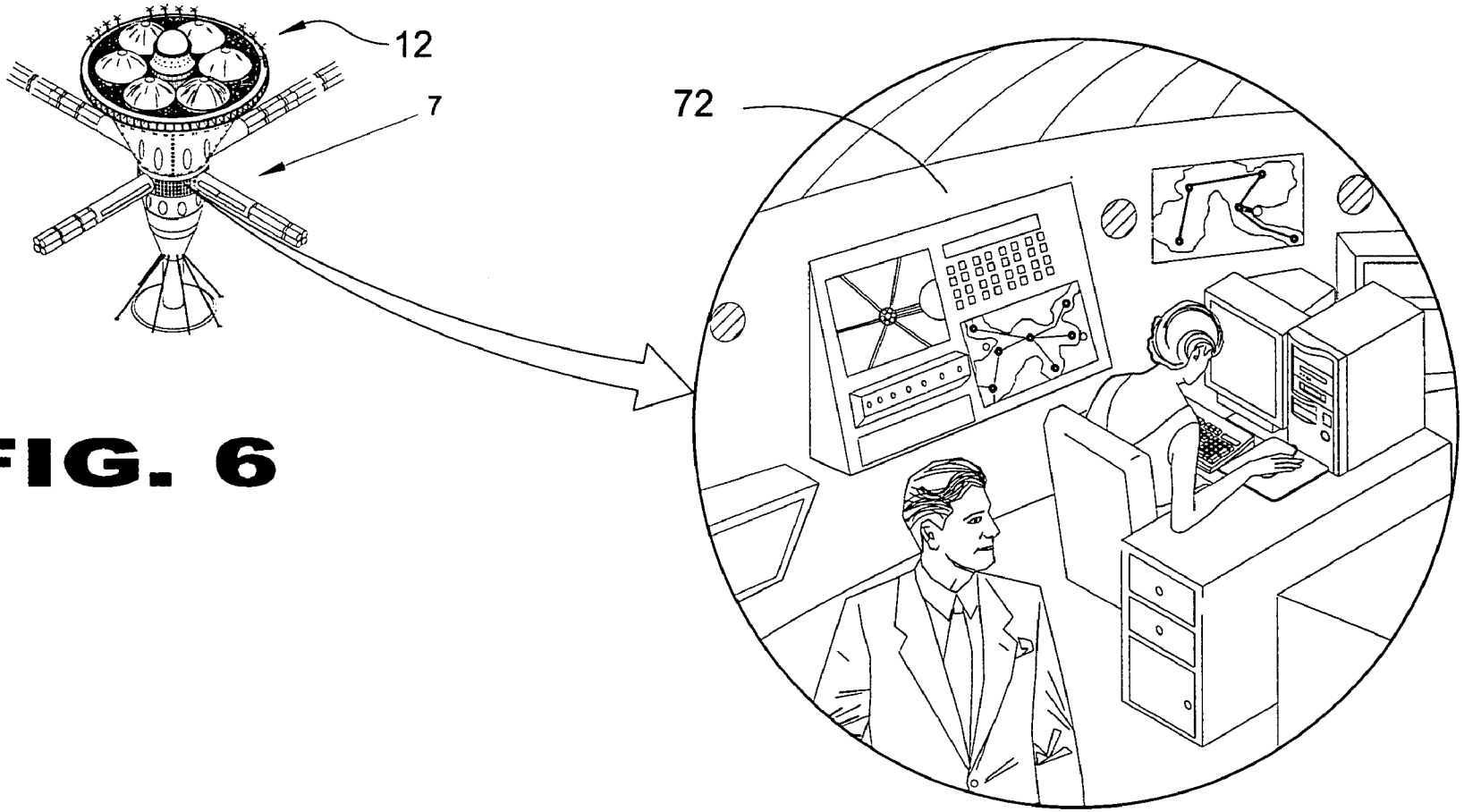
FIG. 6 is a detail view of the engineering section of the aqua station.

FIG. 6 is a detail view of the engineering section 72 of the aqua station 12. Shown is a partial view of the engineering quarters. All transport system operations are monitored and conducted at this level. This level of the aqua station 12 is under the water surface. The utility section includes storage and repair facilities for tube link components and other elements of the transport system.

Figure 7:
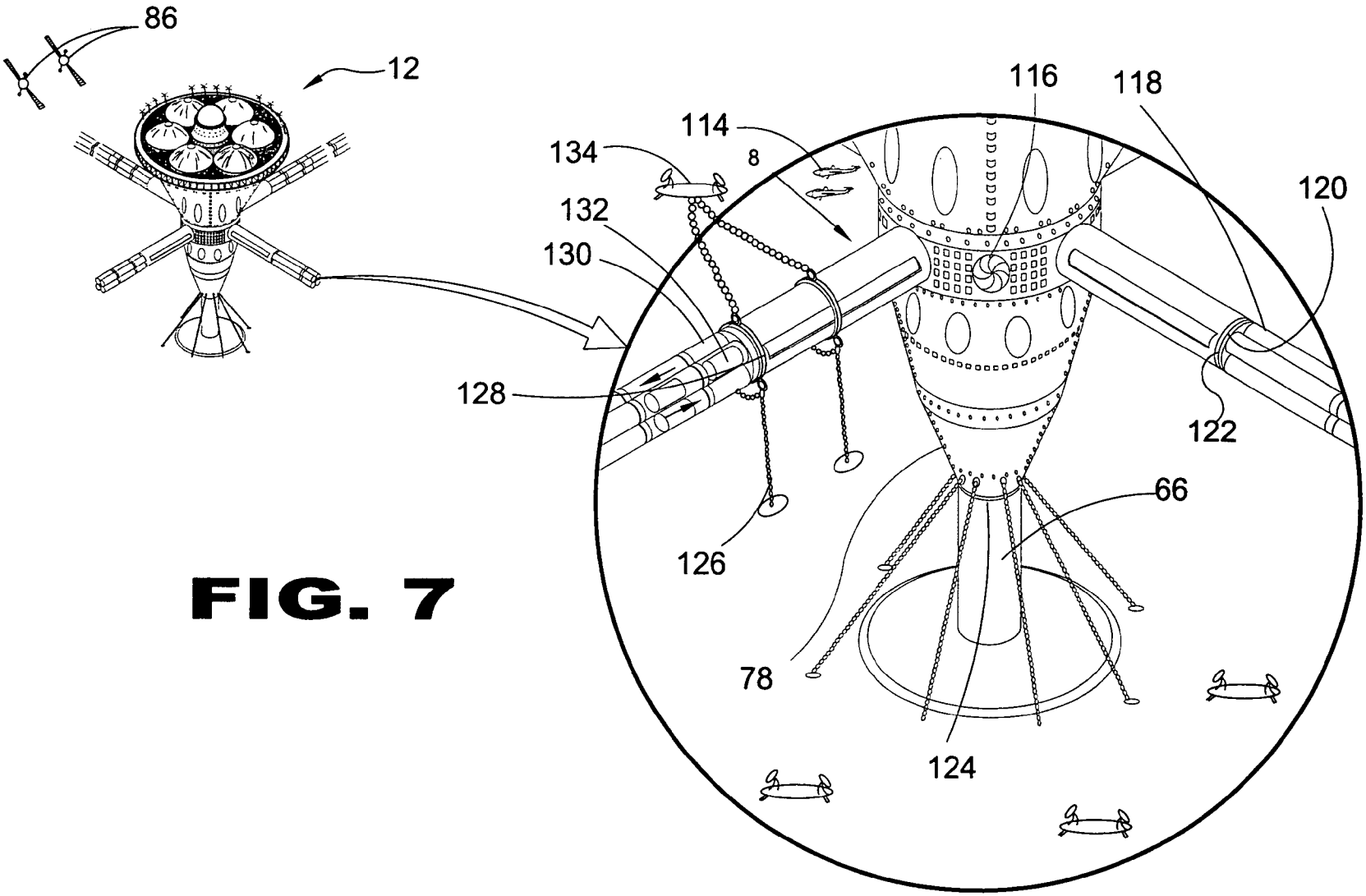
FIG. 7 is a detail view of the transport tubes and security system.

FIG. 7 is a detail view of the transport tubes 130 and security system. The approximate diameter of the transport tube 130 is 15 to 18 feet. The cylinders 132 are approximately 12 feet in diameter and are propelled through the tube networks at up to 14,000 miles per hour to their desired location. Also shown are the solar powered drone security and defense vehicles 114, a security and defense floating platform, 134, security and defense platform attachment ring 128, stabilization anchors for tube link 126, sub-surface lights 78, emergency detachment connector with iris seal 124, a hydraulic stem 66 to permit the entire station to submerge if required, an iris 122 behind the connector joint, a water tight plug-in external tube link connector 120, an extension to tube link line transport tubes 118 and a transport system extension cavity 116.

Figure 8:
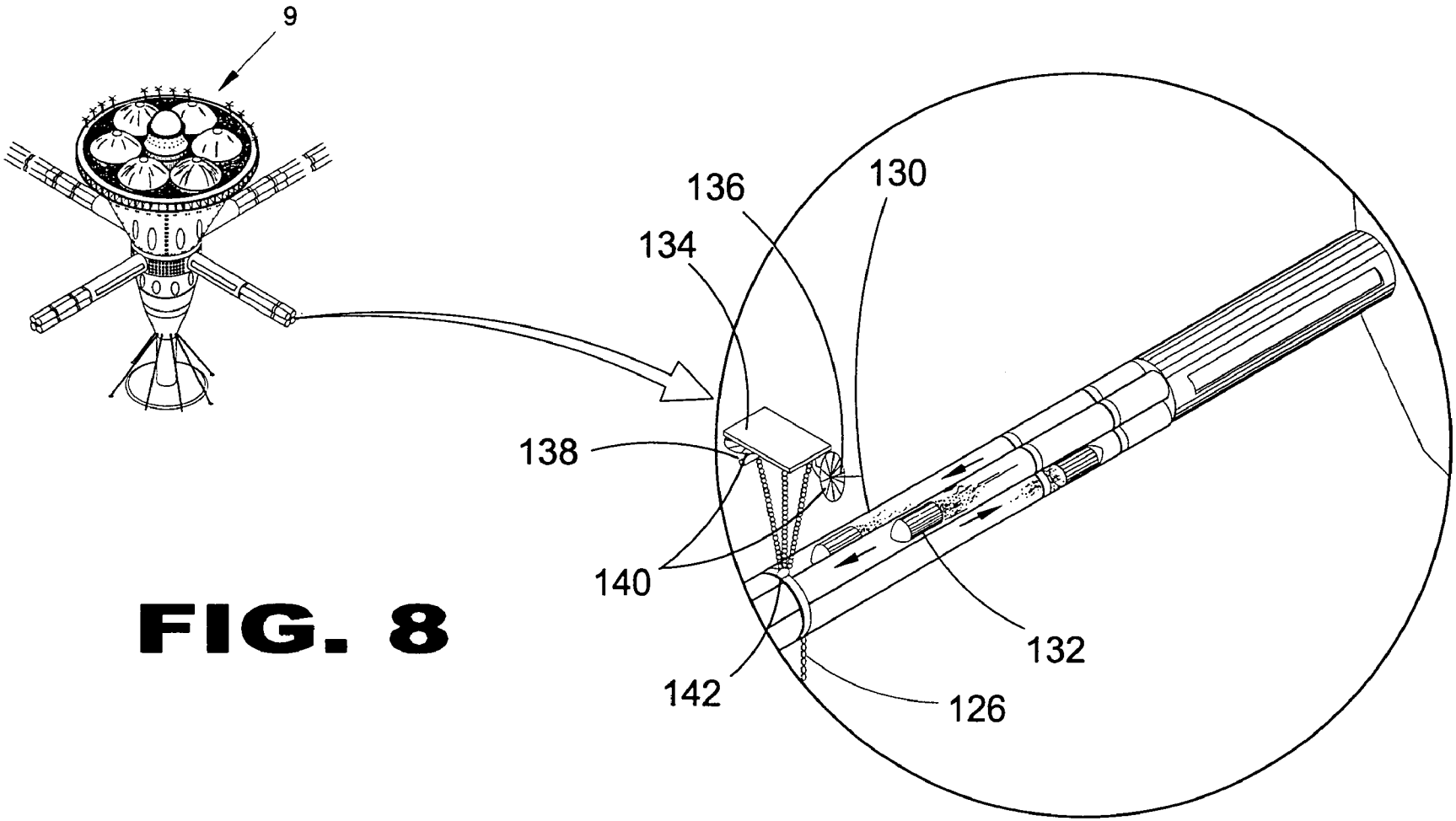
FIG. 8 is a detail view of the transport tubes with cylinders propelled.

FIG. 8 is a detail view of the transport tubes 130 with cylinders 132 propelled. The approximate diameter of the transport tube 130 is 15 to 18 feet. The cylinders 132 are approximately 12 feet in diameter and are propelled through the tube networks at up to 14,000 miles per hour to their desired location. Also shown is the security and defense floating platform 134 with radar and laser 136, sub-water surface torpedo launcher tubes 138, sonar and electro security system 140, holding clamp and stabilization anchors 126.

Figure 9:
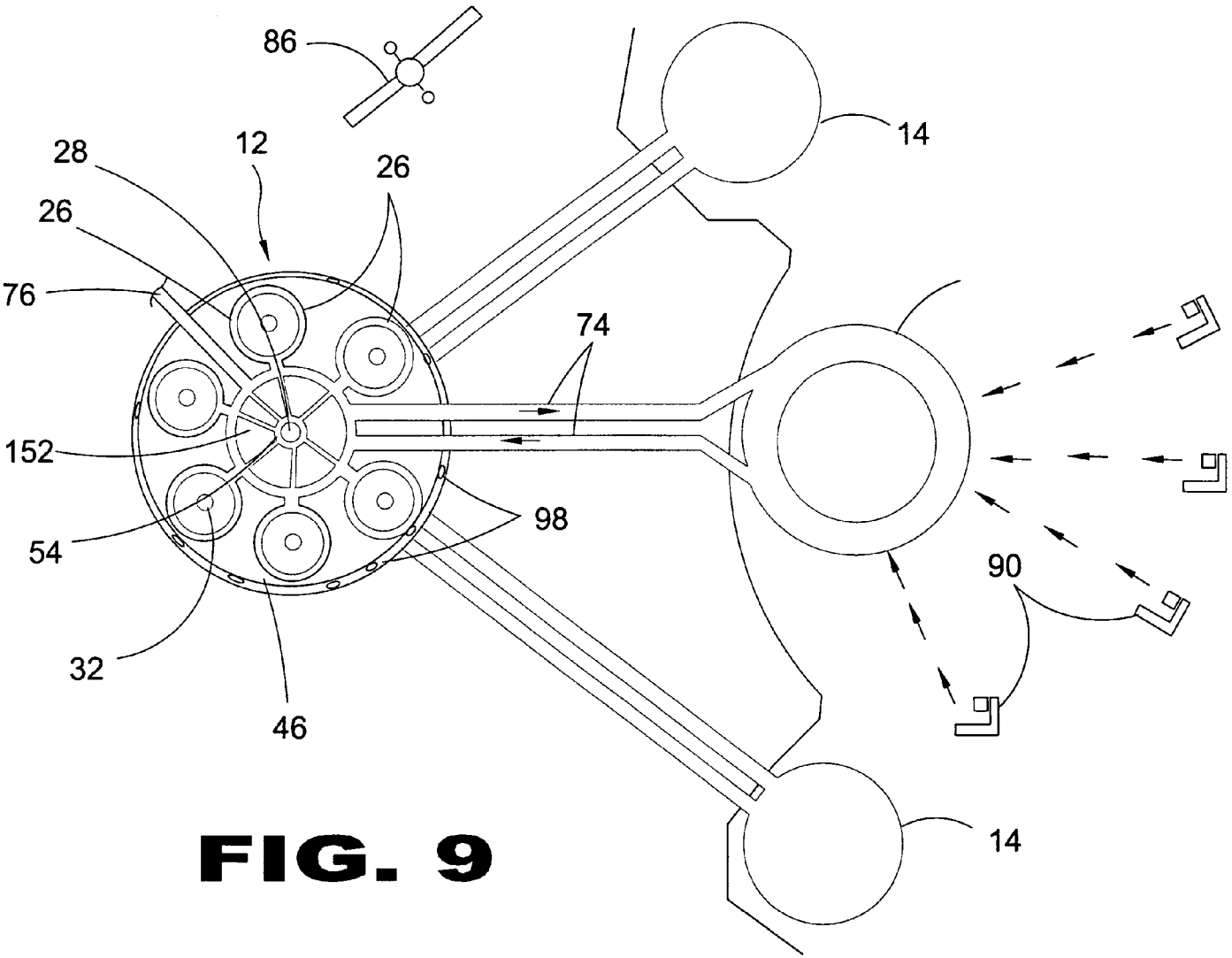
FIG. 9 is a top view of the aqua station and terra station link.

FIG. 9 is a top view of the aqua station 12 and terra stations 14 link depicting a link between the aqua transport station to the terra station 14 via a tube link 74. Also shown is the internal circumference transport system 98 and orbiting security and defense space satellites 86, central energy core 28, satellite sub station 26, transportation tube 76, external tube link landing and loading docks 152, elevator tube system 54, solar self sufficient energy source 32, garden and outdoor activities center 46 and cities 90 proximal to the terra stations.

Figure 10:
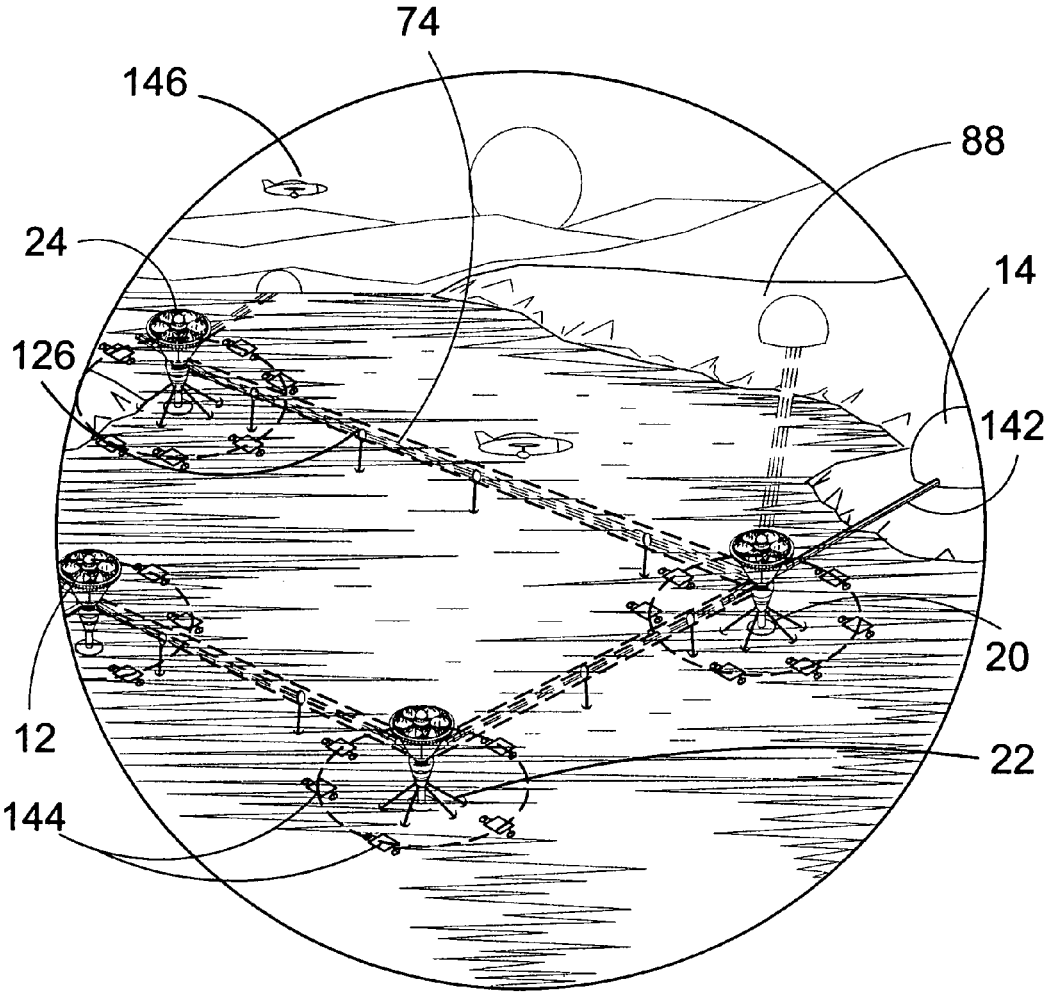
FIG. 10 is a perspective view of the aqua links to a terra station.

FIG. 10 is a perspective view of the aqua links to a land 88 based terra station 14. Shown are several aqua stations 12 connected by transport tubes 74 to one another and also connected to terra stations 14. Also shown are the retractable master dome 24 tube link stabilization anchors and security and defense platforms 126, security rings (two mile sensors, radar, sonar, visual and audio) and defense platforms 144, retractable anchors 22, anchor base 20, and the main link to terra station 14

Figure 11:
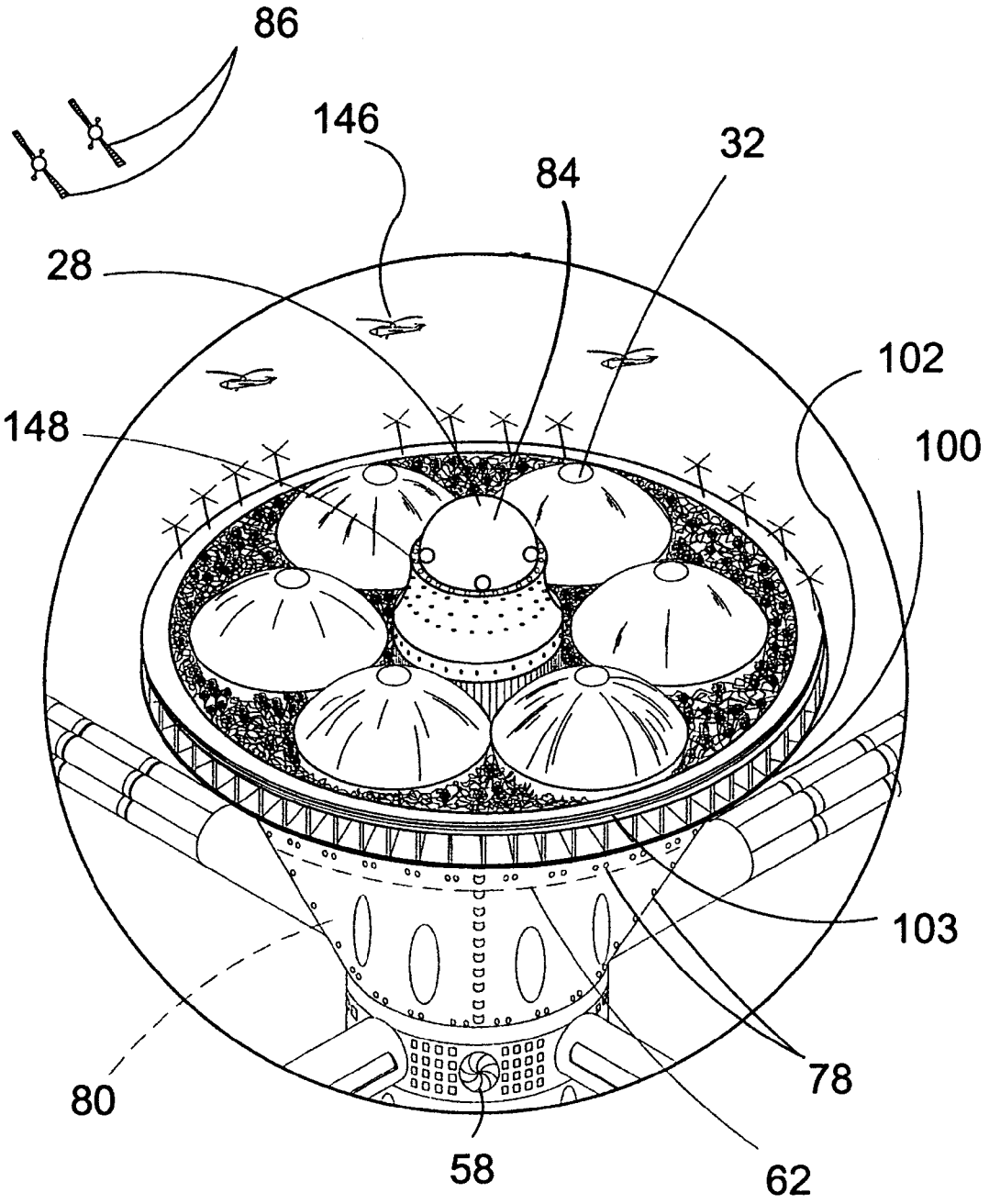
FIG. 11 is a detail view of the central and alternative energy sources and the defense system.

FIG. 11 is a detail view of the central and alternative energy sources and the defense system. The main source of energy comes from the central solar base energy core 28. Each self-sufficient floatable dome may be powered by its own alternate power source. Additional wind 84, ocean 80 and other energy sources shall be used such as an alternate self sufficient solar energy source 32. The defense system is activated by non-response and confirmed non-directional change. The shield and laser defense is activated upon the non-response and confirmed non-directional change by the incoming object. A retractable upper security curtain 103, an upper security curtain groove 102 and lower security curtain 100 provide additional security. Drones 146 are also available security. Also shown are a directional scrambler security and defense system 148 that rises and retracts 25 feet, a double waterfall energy system 80, extension cavity water tight double iris seal 58, ballast compartment 62 going around the entire circumference, sub-water lighting 78 and security and defense hemispheric satellites 86.

Figure 12:
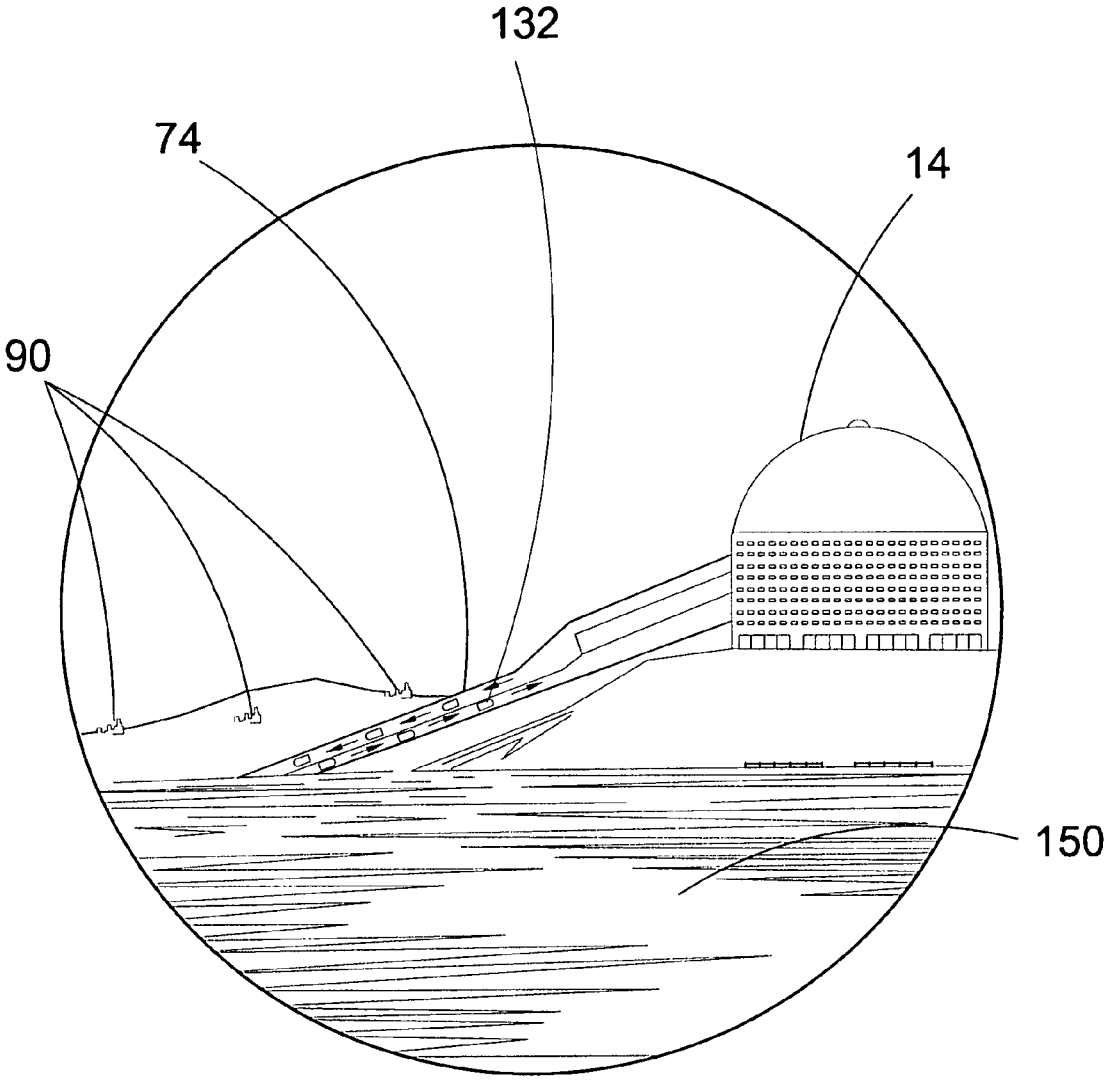
FIG. 12 is an illustrative view of the floatable terra station of the present invention.

FIG. 12 is an illustrative view of the floatable terra station 14 of the present invention. The floatable terra (land) stations 14 provide the ocean 150 based aqua stations 12 with goods from shore via the transport tubes 74 and transport cylinders 132. Supplies and goods are transported to the land station from cities 90 near and far. Once the products enter the tube system, they may be transported to any destination along the tube link network 74 via a computerized coding system. Ultimately, the world public will travel long distances via this transport system. High tech security systems will also be installed in all aqua and terra stations.

Figure 13:
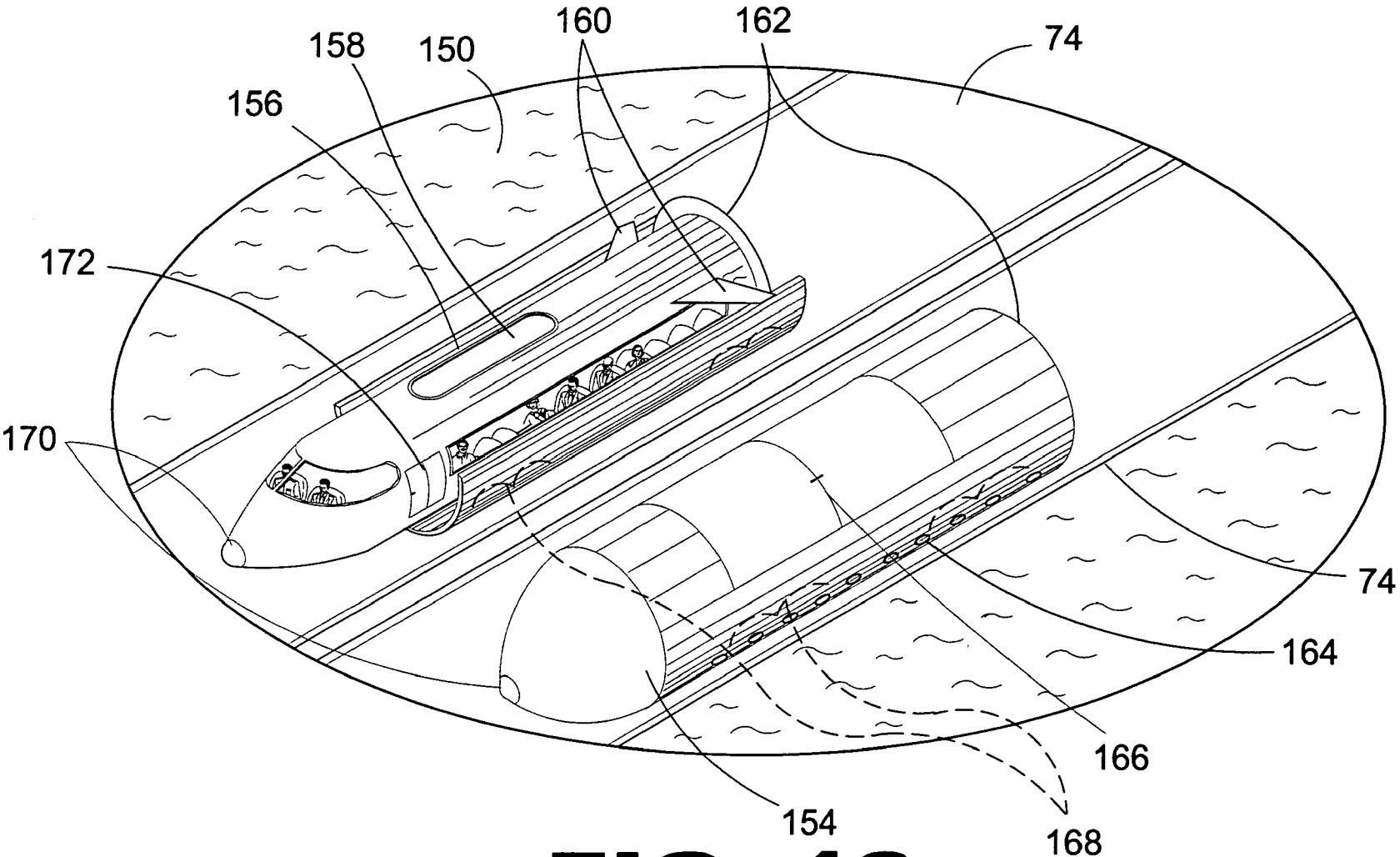
FIG. 13 is a perspective view of the transport cylinders of the present invention.

FIG. 13 is a perspective view of a human transport cylinder 156 and a cargo transport cylinder 154 of the present invention. The electromagnetic sub-water transportation system operates through the use of magnetic and pneumatic principles. It may propel a cylinder through a tube link network 74 which is located below the oceans 150 surface, to other systems located in distant areas from each other. The cylinders may further include retractable fins 160 rear swivel blades 162, aquatic turbo thrusters 164, loading and unloading doors 166, external capsule status sensors and directional navigations device 170, a sliding water tight door 172 and a watertight emergency escape hatch 158.

Figure 14:
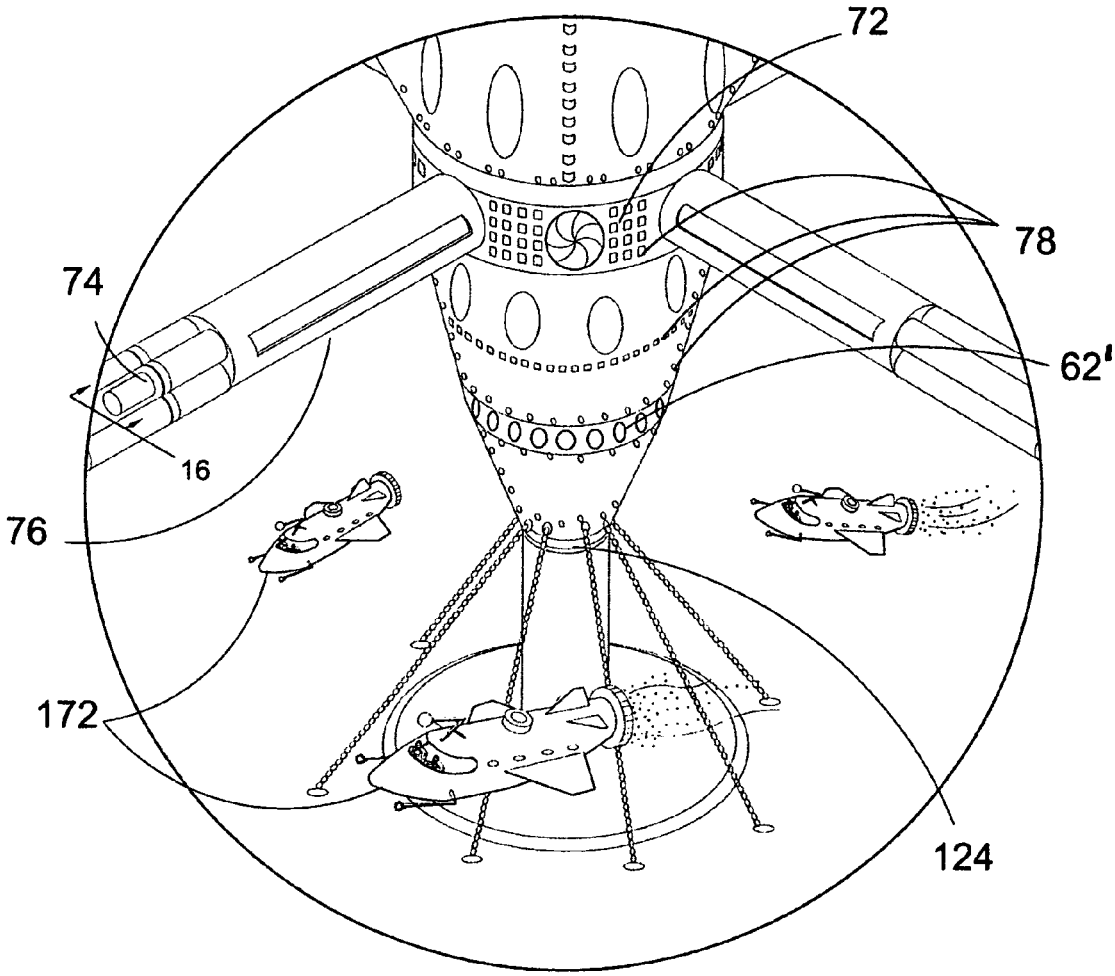
FIG. 14 is an illustrative view of the security and maintenance sub-surface vehicles of the present invention.

FIG. 14 is an illustrative view of the security and maintenance subsurface vehicles 172 of the present invention. The transportation tube link 74 may be patrolled and maintained by engineering 72 through the use of under water vehicles capable of doing the required external repairs necessary. Additionally, some vehicles may be armed with torpedoes to secure the station and tube link network 74. Also shown is the sub-surface lighting 78, ballast compartments 62', detachable section and connector with iris water seal 124 and the multi-flex tube link section 76.

Figure 15:
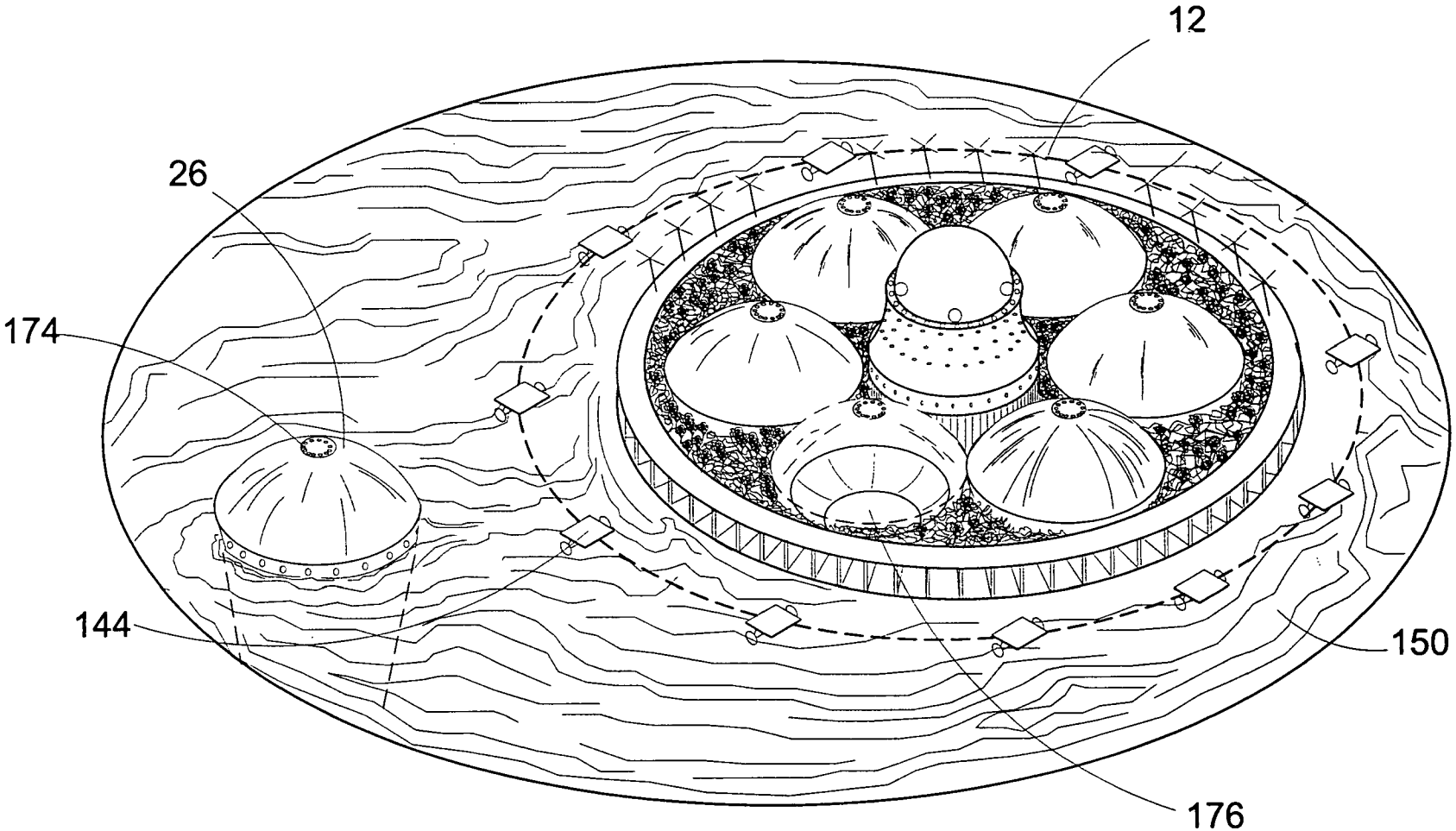
FIG. 15 is an illustrative view of the self-sufficient, floatable dome independent from the master aqua station.

FIG. 15 is an illustrative view of the self-sufficient, floatable dome 26 independent from the master aqua station 12. Each self-sufficient dome 26 consists of its own power source, living quarters, food and water supply and is entirely independent from the main master dome. Security and defense features are provided on a smaller scale to all substations 26 by a sub-station security and defense system 174. Also shown is the substation cavity 176 prior to insertion of substation 26.

Figure 16:
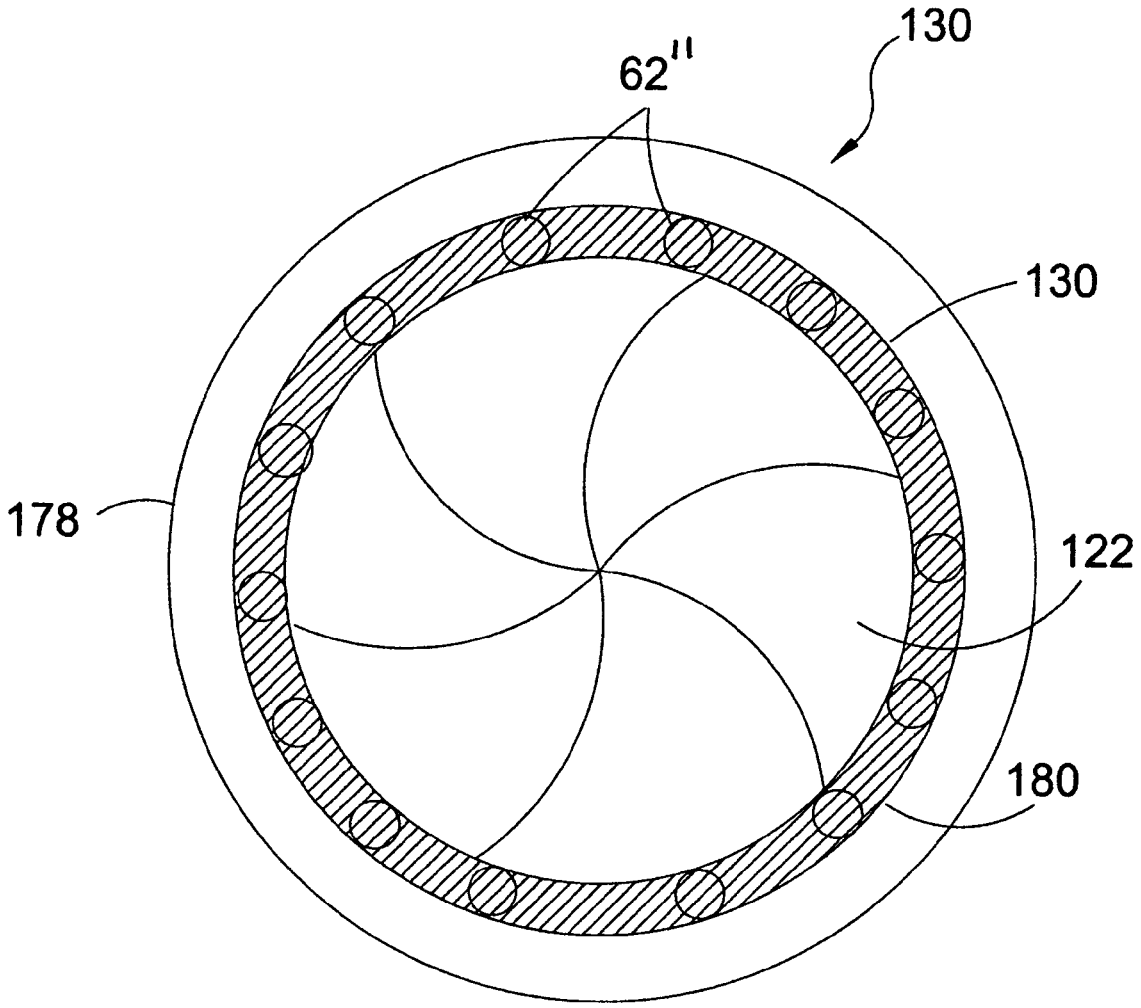
FIG. 16 is a sectional view of the tube end sealing iris of the present invention.

FIG. 16 is a sectional view of the water tight plug in external tube link connector 120 of the present invention. At the end of each tube link 130 is a watertight suction connector 178 and its iris seal 122 to seal off a pressurized area 180, thereby preventing water from entering. Also shown are ballast compartments 62".

Figure 17:
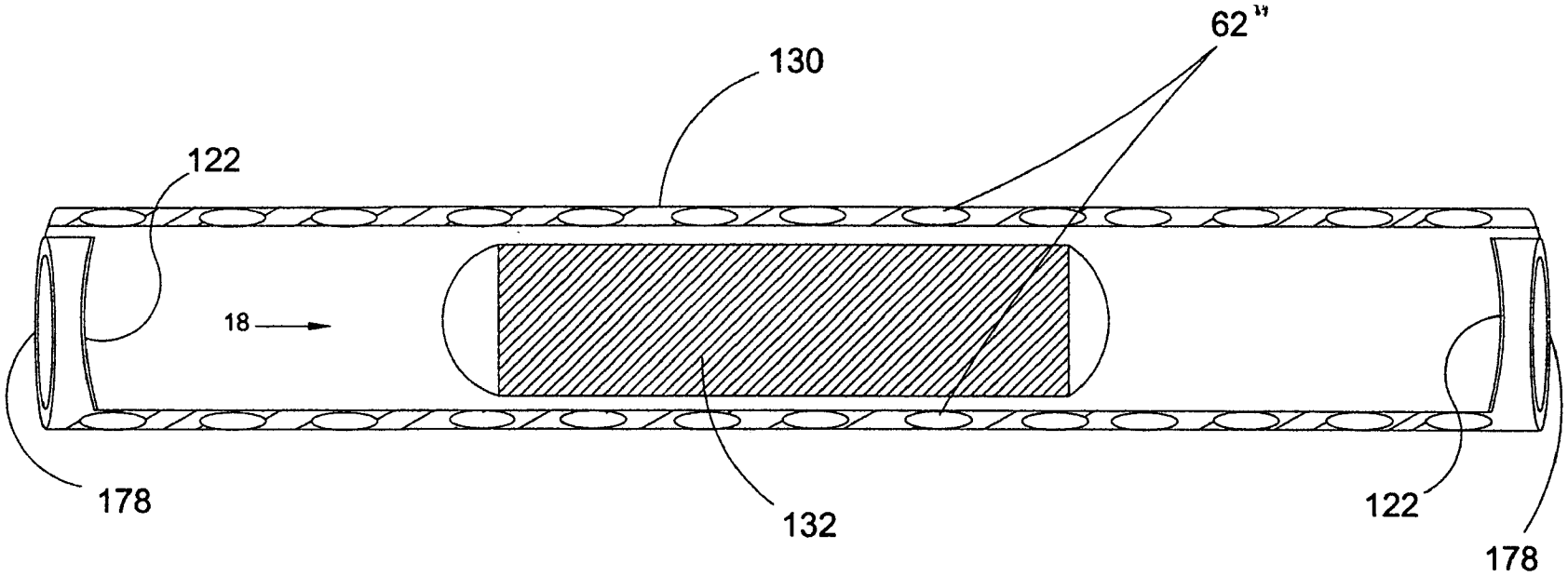
FIG. 17 is a cross sectional view of the tube and cylinder of the present invention.

FIG. 17 is a cross sectional view of the tube 130 and cylinder 132 of the present invention. Shown are the transport tubes 130 of the present invention. The approximate diameter of the transport tube 130 is 15 to 18 feet with a length of 30 to 50 feet per section. The cylinders 132 are approximately 12 feet in diameter and are, at full speed, propelled through the tube network 74 at up to 14,000 miles per hour to their destination. Also shown are the iris seals 122, the suction connectors 178 and the ballast compartments 62".

Figure 18:
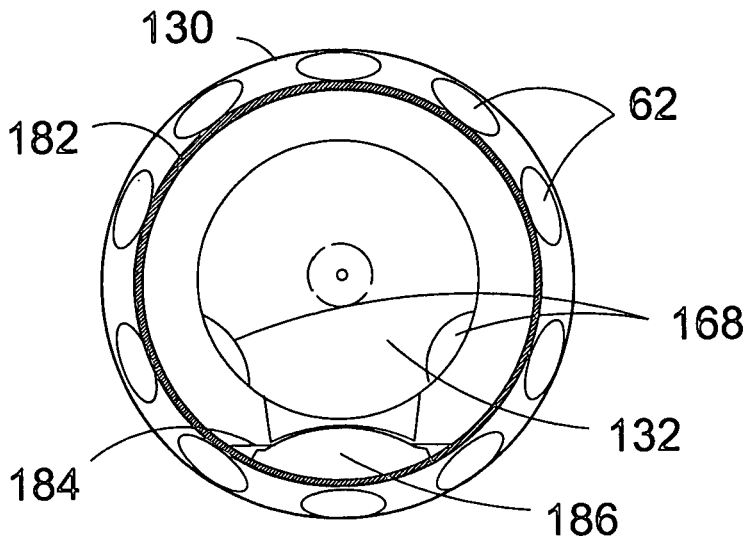
FIG. 18 is a cross sectional view of the tube and cylinder of the present invention.
Figure 18:
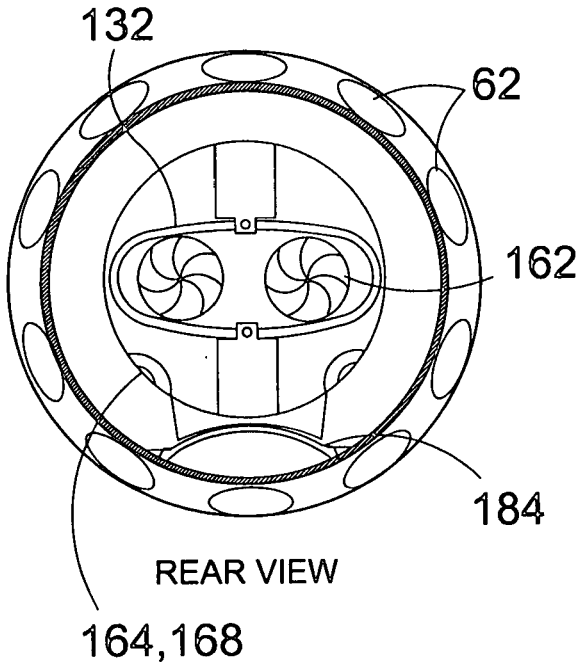

FIG. 18 is a cross sectional view of the tube 130 and cylinder 132 of the present invention. Shown are the transport tubes 130 of the present invention. The approximate diameter of the transport tube is 15 to 18 feet. The cylinders 132 are approximately 12 feet in diameter and are propelled through the tube networks at up to 14,000 miles per hour to their destination. Also shown are the internal double wall 182, high speed wheel platform 184, the electromagnetic line 186, retractable high speed wheels 168, ballast compartments 62, rear swivel blades 162 and aquatic thrusters 164.

Figure 19:
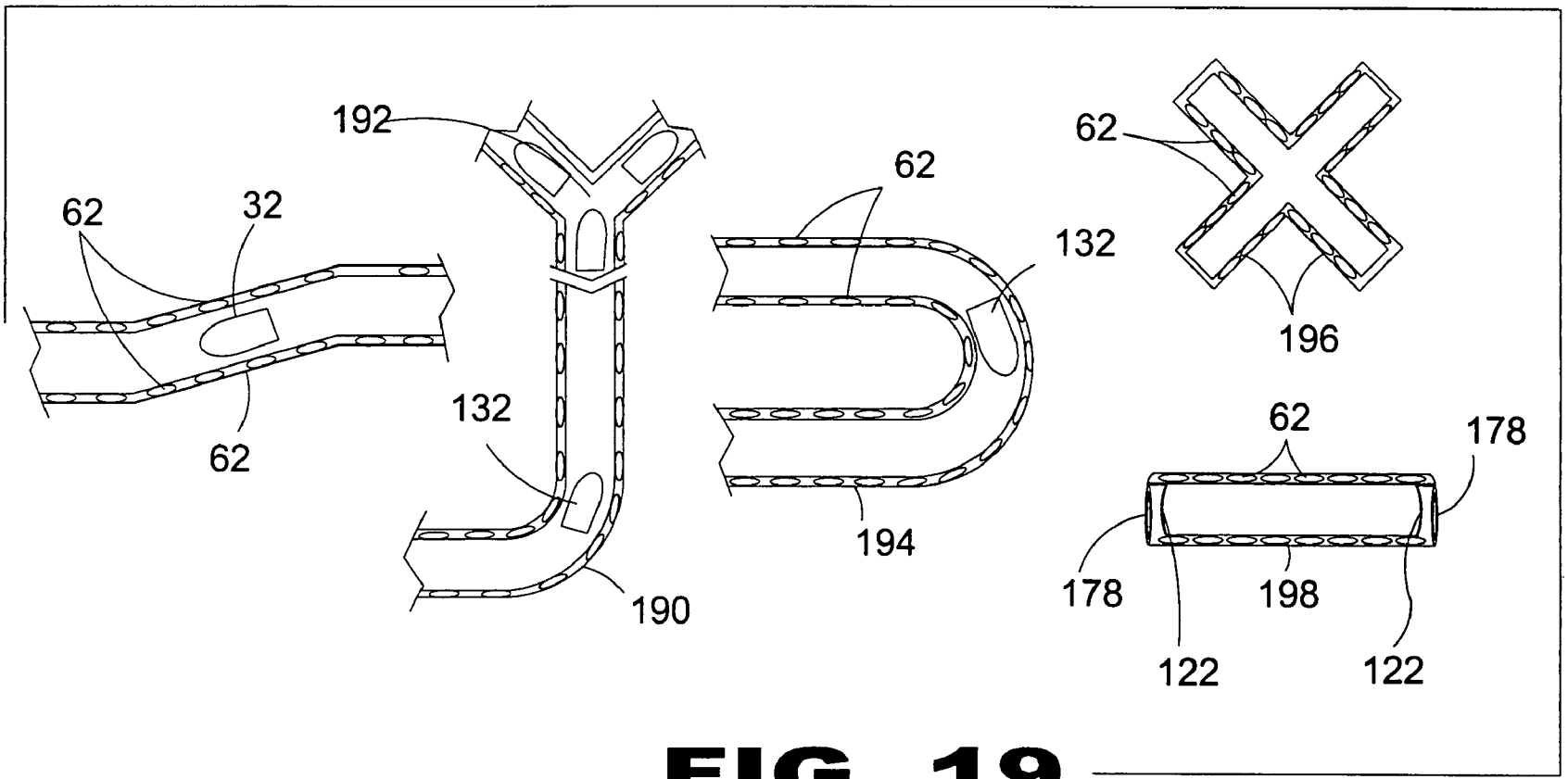
FIG. 19 is a side view of the alternate shaped transportation tubes of the present invention.

FIG. 19 is a side view of the alternate shaped transportation tubes 130 of the present invention. Shown are various configurations for the transport tubes 130 of the present invention. The approximate diameter of the transport tube 130 is 15 to 18 feet. The cylinders 132 are approximately 12 feet in diameter and are propelled through the tube networks 74 at up to 14,000 miles per hour to their destination. Shown is an offset tube link 188, a 90-degree tube section 190, a "Y" shaped tube section 192, a "U" shaped tube section 194, a crossing connector tube section 196, and a straight tube section 198. also shown are iris seals 122, suction connectors 178 and ballast compartments 62.

Figure 20:
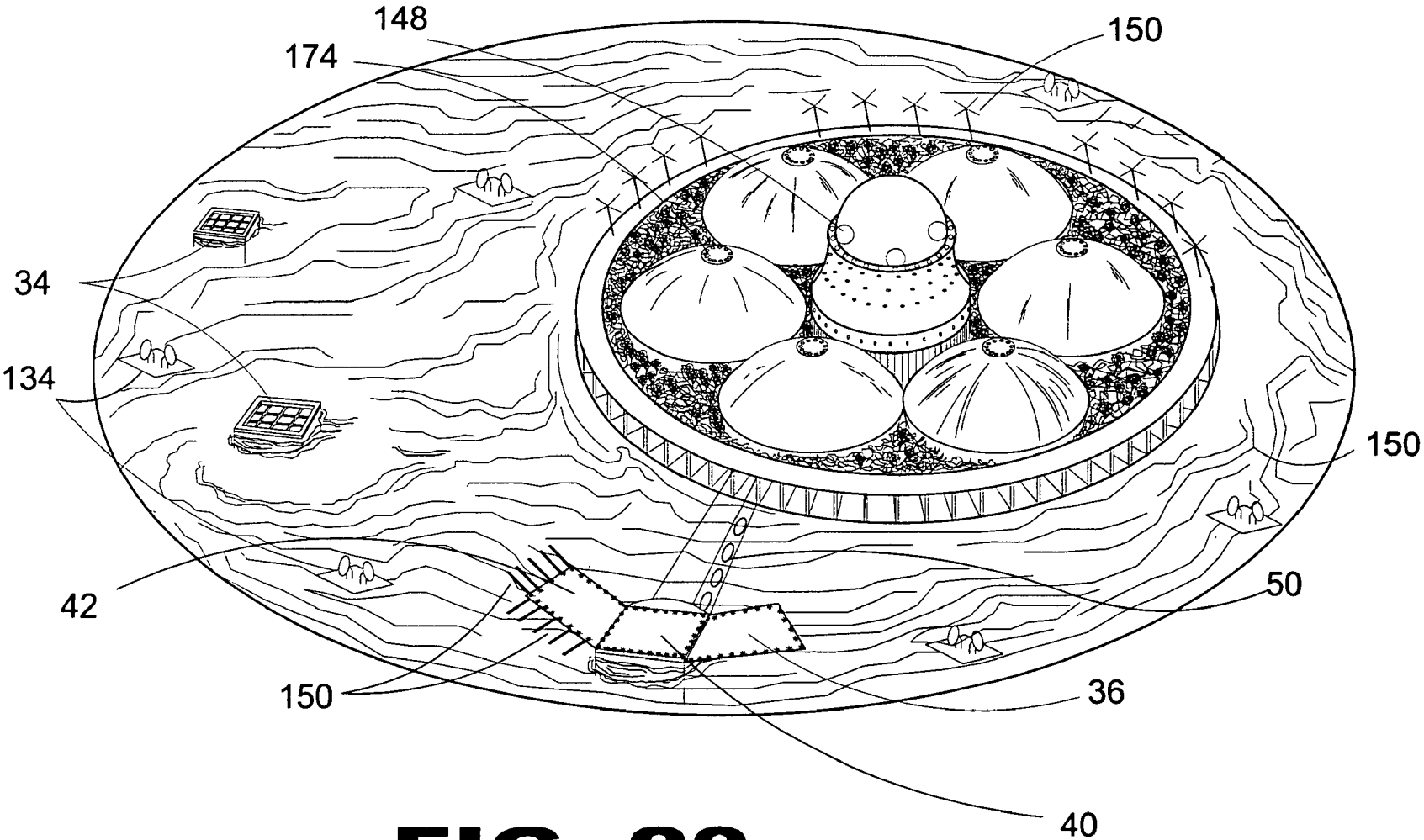
FIG. 20 is an illustrative view of a floating farm of the present invention.

FIG. 20 is an illustrative view of a floating farm 34 of the present invention. Floating farm stations 34 are provided and are located around the surrounding ocean 150 waters of the aqua station 12. Each farm 34 provides an abundance of aquatic foods raised and cared for as a source of food for the people aboard the aqua stations 12 and worldwide consumer community. Further out from the aqua station 12 is the 2-mile security and defense system 134. Also shown are the ship cargo passenger loading and unloading platform 42, the loading and unloading platform from tunnel 40, the vertical landing platform for aircraft 36, port holes 50 on both sides of the tunnel, the directional scrambler security and defense system 148 and sub station security and defense system 174.

Figure 21:
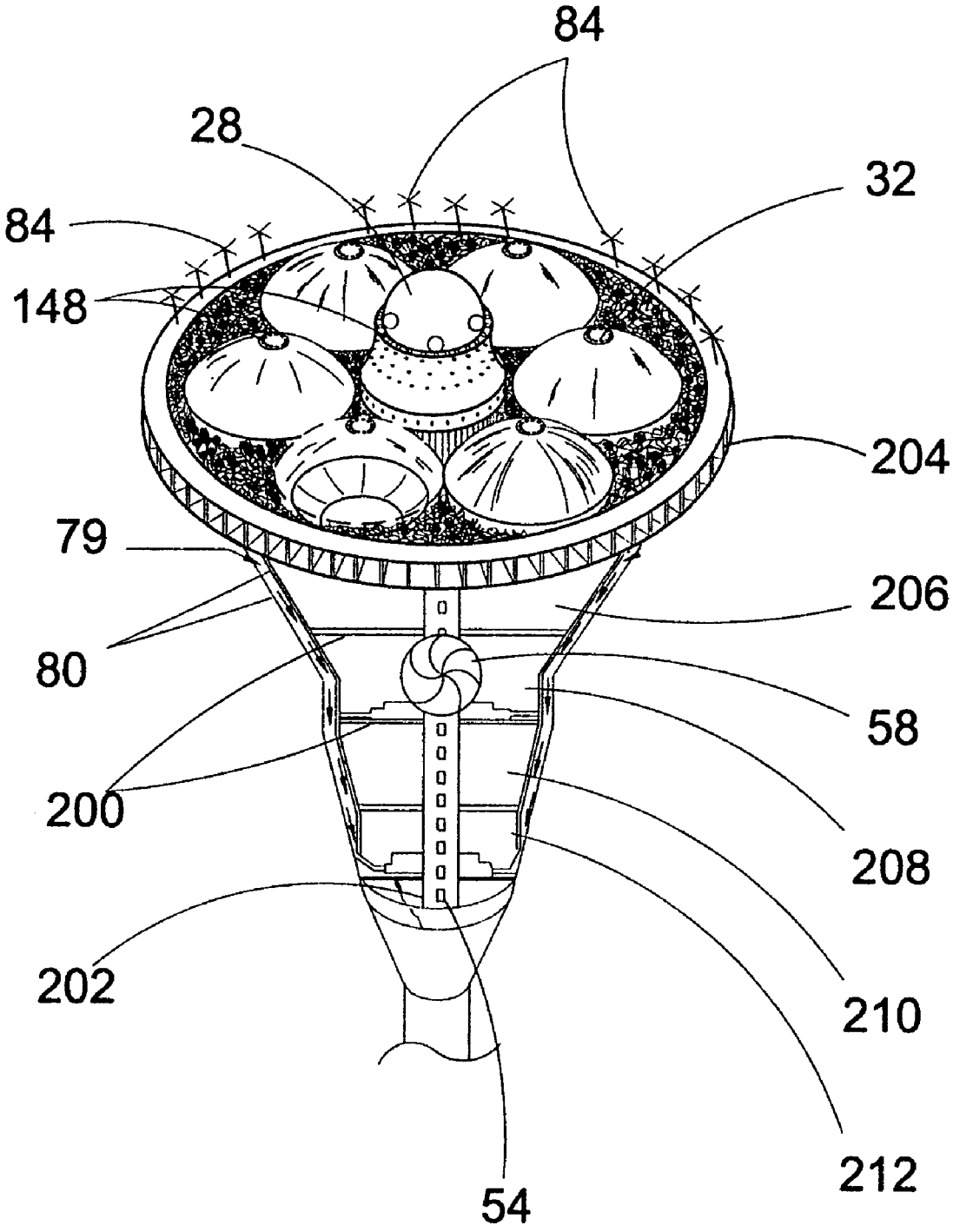
FIG. 21 is a sectional view of the present invention.

FIG. 21 is a sectional view of the aqua station 12 of the present invention. Water enters the double wall hull 80 and cascades down to turn turbines for generators, while en route to desalinization section. Also shown are the central solar base energy source 28, wind energy source 84, directional scrambler security and defense system 148, the waterfall energy source 79, the sub-floor space for wire distribution 200, the central energy core 202 and wiring network leading to each level and sub floor distribution, the central elevator 54, the alternate self sufficient solar energy source 32, level one 204 the upper main level containing housing, greenhouse, farming entertainment/sports complex and operation control, level two 206 containing housing, sea farming and an entertainment complex, level three 208 containing engineering, loading and unloading, storage and turbines, level four 210 containing housing, entertainment and educational center and level five 212 containing storage, rod section, science labs and manufacturing.

Figure 22:
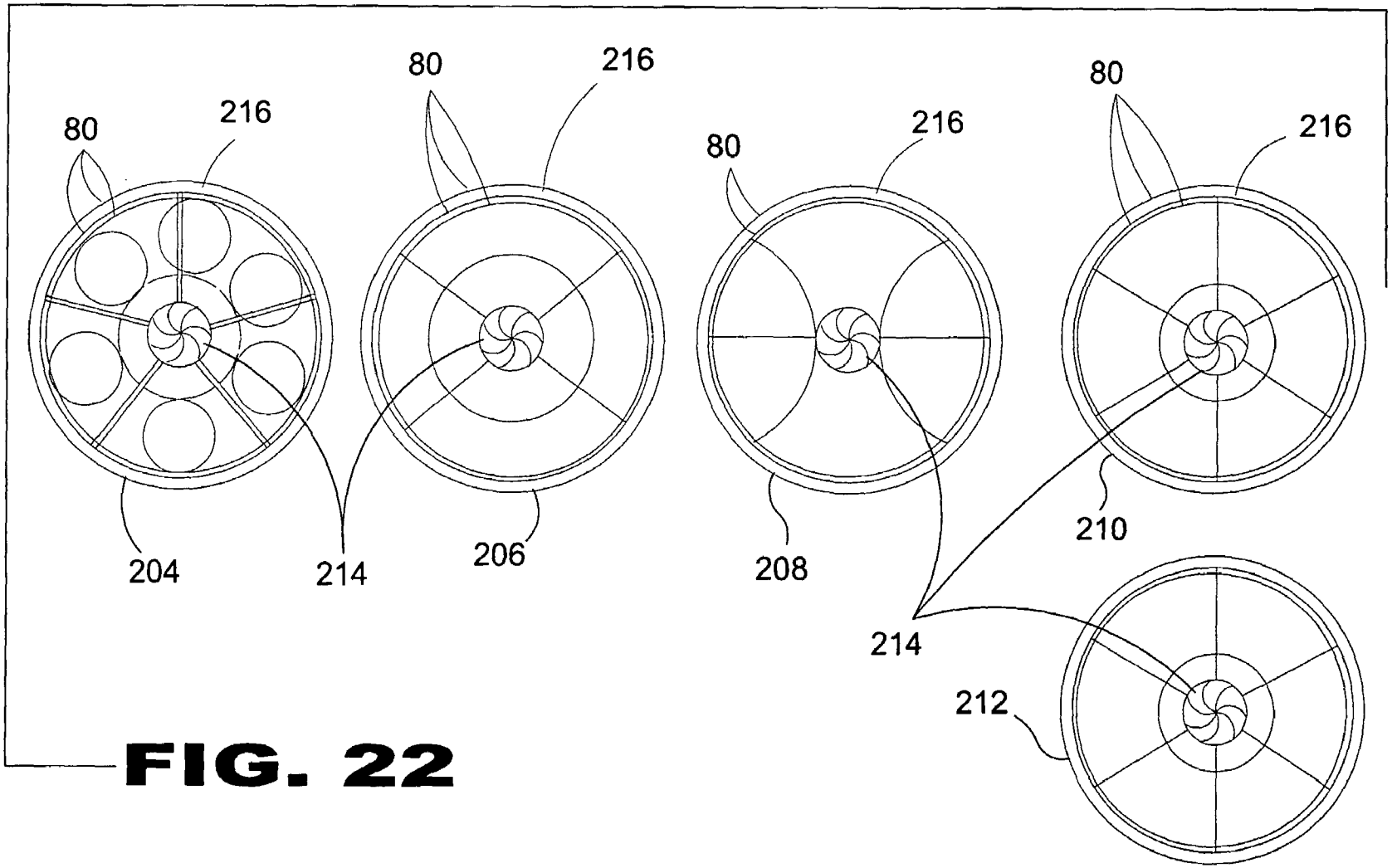
FIG. 22 is a floor plan of the present invention.

FIG. 22 is a floor plan of the present invention. Shown above are some of the different levels or floor plans provided within the interior housing of the present invention. Also shown is the double wall hull 80 of the present invention showing water access, allowing water to enter and provide energy to turn turbines for the generation and distribution of power. Shown are level one 204, level two 206, level three 208, level four 210 and their respective double walls 80 and water fall intakes 216 and level five 212. all levels have water tight emergency iris seals 214.

Figure 23:
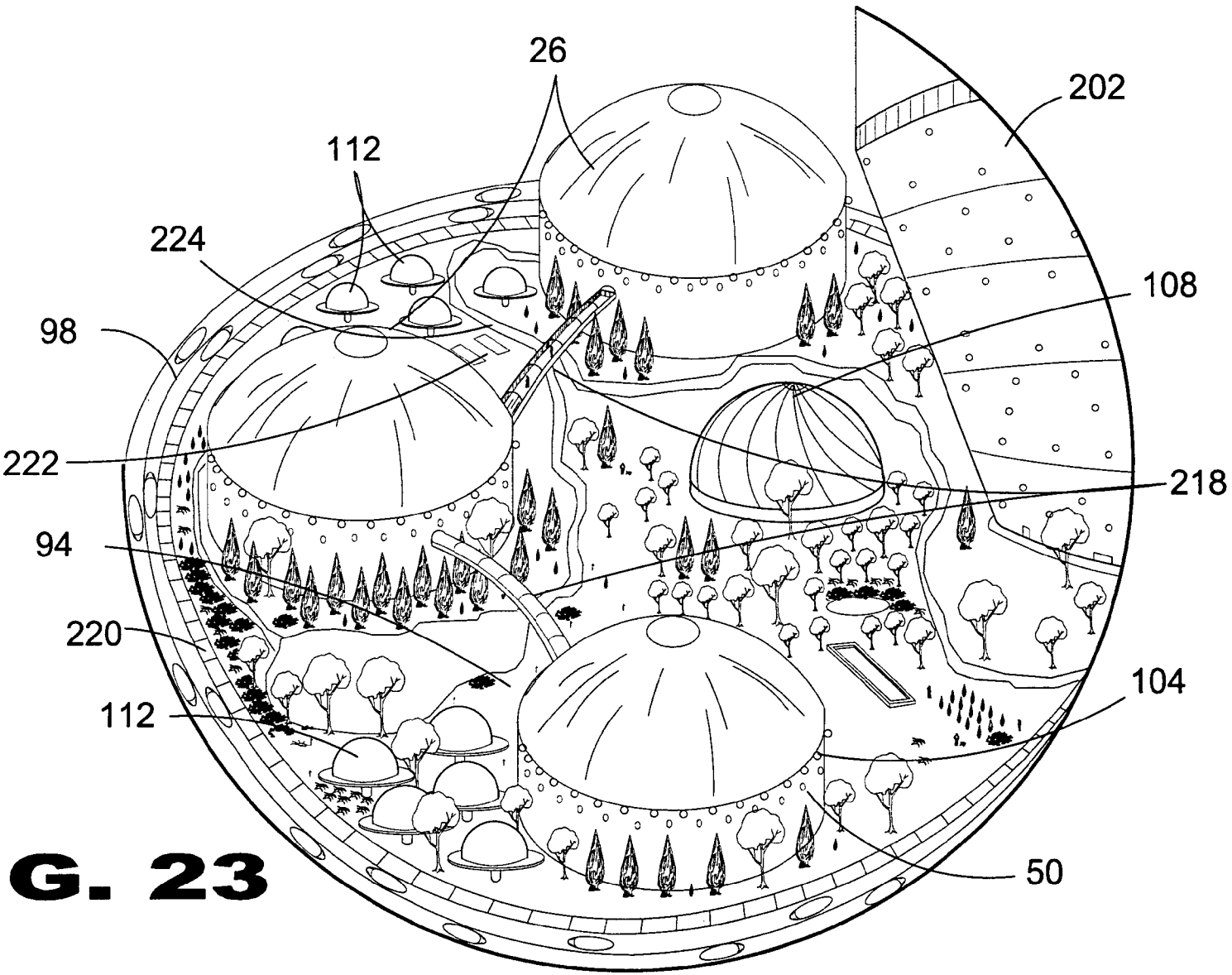
FIG. 23 is an illustrative view of the present invention.

FIG. 23 is an illustrative view of the present invention. Shown is a section of the present invention having a plurality of recreational facilities, living quarters and transportation system. Shown are sub-stations 26, the master central core 202, retractable dome sports arena 108, sub-surface walkways connecting sub-station 26 to sub-station 26, circumference external lighting 104, circumference portholes 50, elevated housing 112, circumference sports track 220, 18 hole golf course 94, recreational park 222, internal circumference transport system 98, and river and streams 224.

Figure 24:
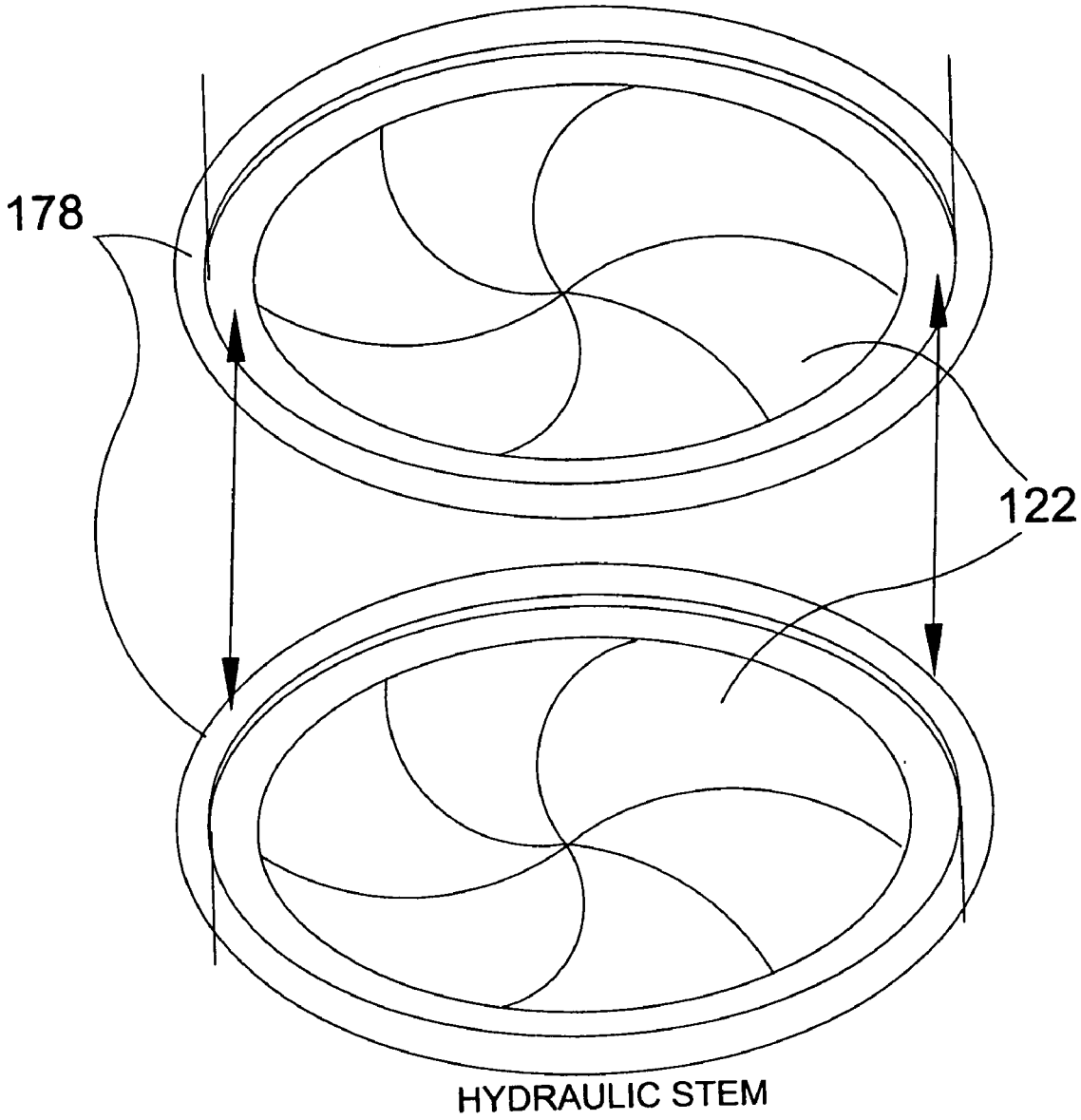
FIG. 24 is a sectional view of the tube end sealing iris and suction connector of the present invention.

FIG. 24 is a sectional view of the tube end sealing iris 122 and suction connector 158 of the present invention. An iris seal 122 is provided to seal off a pressurized area and prevents water from entering. It is used at the junction between the hydraulic stem and the lowest point of the main aqua station and between each level.

Figure 25:
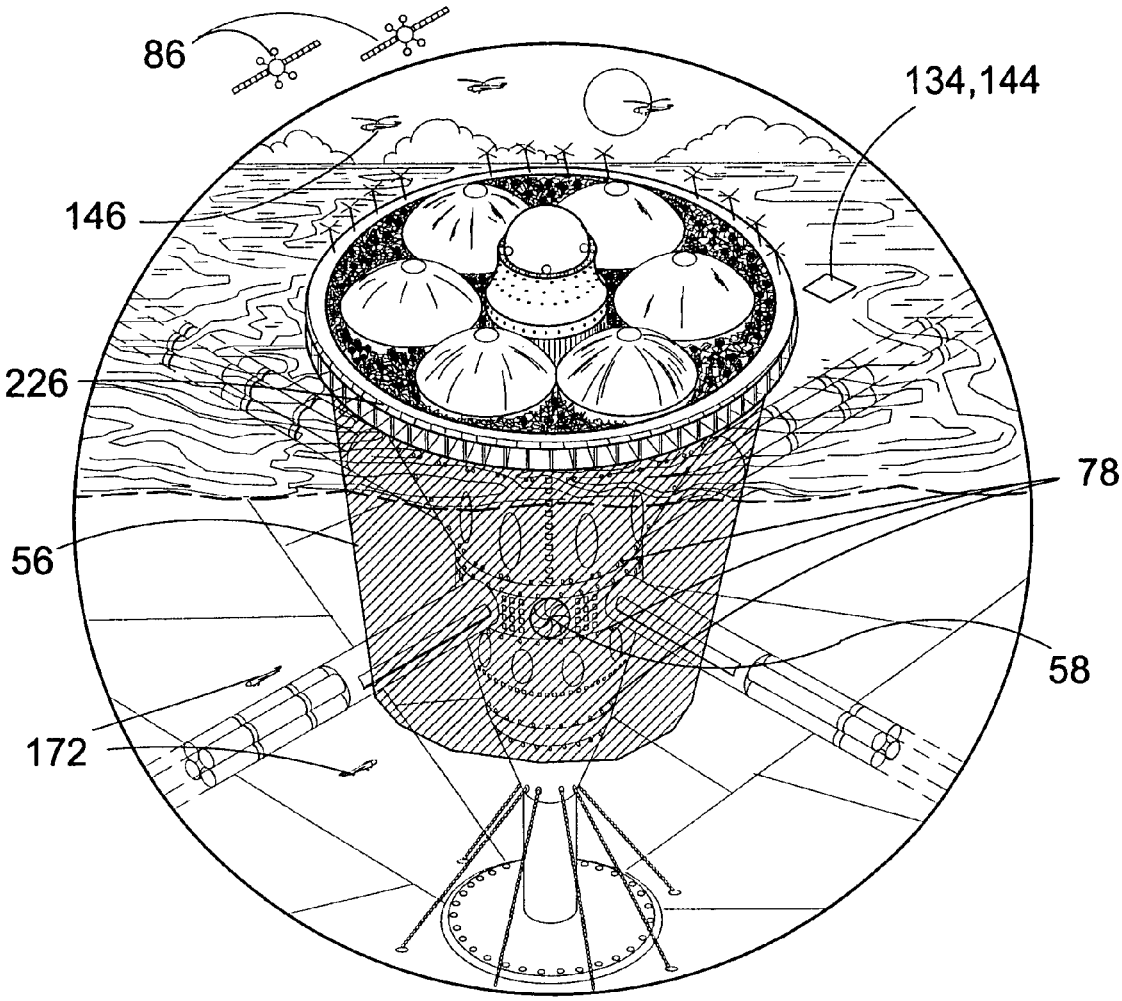
FIG. 25 is an illustrative view of the external security and defense system components.

FIG. 25 is an illustrative view of the external security and defense system components. The external security system is comprised of various elements and functions including defense above and below the surface of the body of water where the aqua station and tube link network may be located. The aqua stations are protected by a security and defense system to be located on floating and anchored platforms forming a two mile circumference detector and security field around each aqua station. The two mile detector field 144 will be equipped with radar, specialized sonar, visual and audio capacity. Laser defense instruments and smart torpedoes are available to intercept aircraft, above and below ocean surface vessels, torpedoes and other such threats. Shown are the subwater security vehicles 172, the retractable sub-surface explosion proof stainless and special alloy curtain 56, the retractable water tight sealing door 226, solar and alternate powered flying drone security vehicles 146, hemispheric satellites 86, a mile security and defense system 144 with floating and anchored platforms 134 with radar, laser, torpedo, visual and audio capacity.

Figure 26:
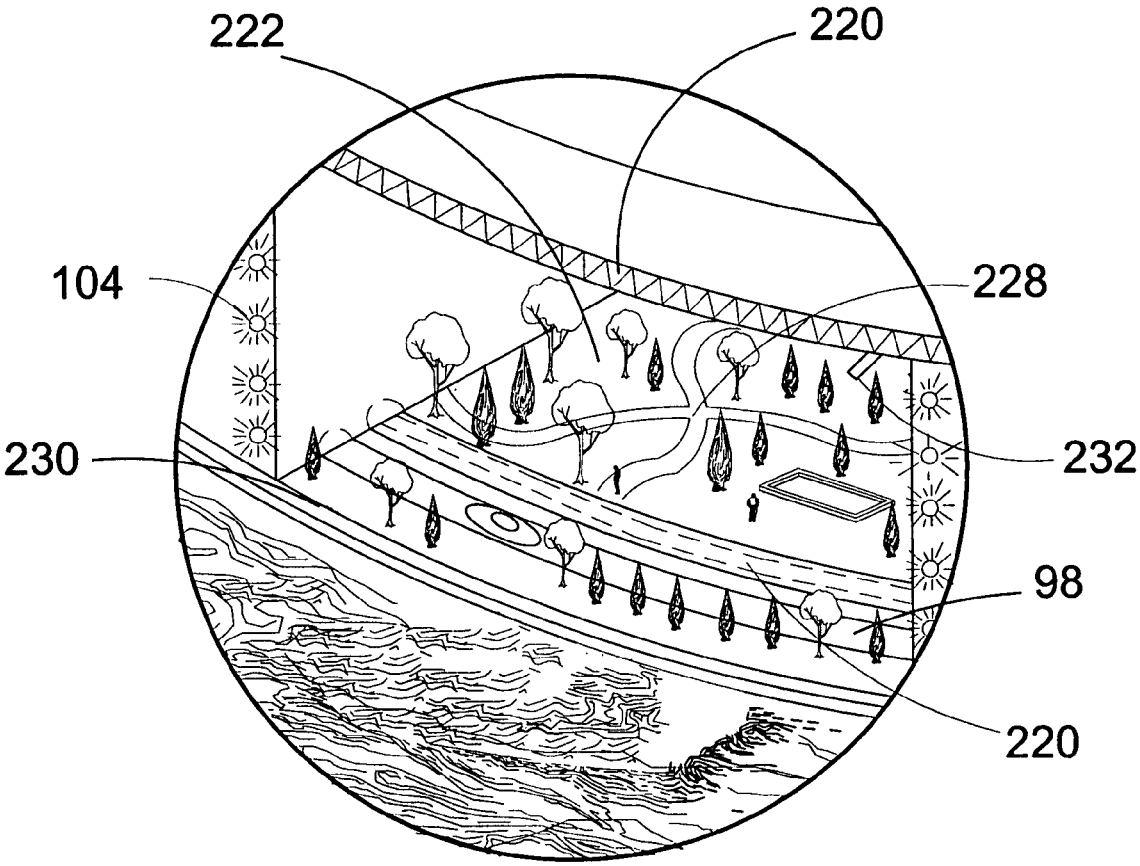
FIG. 26 is an illustrative view of the internal security system.

FIG. 26 is an illustrative view of the internal security system. The entire aqua and terra stations shall be equipped with visual and audio surveillance detection and sensor devices to detect any potential danger or hazard that may exist internally to the aqua station and persons within. Additionally, specially trained security teams will routinely walk the public and private areas of the entire station to assure the safety of all inhabitants and guests. The only transport system contained within the aqua station 14 is the circumference transport system 98. No other people type vehicles will be permitted on the station except for golf carts used on the day and night time golf courses and limited community travel for those physically unable to walk. Sport related facilities will include tracks for bicycle riders, runners and walkers. All of those areas will be secured by sensors, visual, audio detection devices, and security personnel policing all public areas. Shown are the water tight outer rim seal track 230, internal lights 104, recreation area 222, retractable water tight perimeter security curtain 92, pedestrian walks/sport track 228, 360 degree security cameras 232 with audio and other sensors, circumference transport system 98 and external sport track 220.

What is claimed is:

1. An aqua-terra planetary transport system comprising:

a) a plurality of aqua stations disposed in spaced apart relation within a large body of water, each aqua station comprising:

i) a circular surface structure disposed on the surface of said water and having a top and a bottom, said surface structure containing a central energy core surrounded by satellite sub-station domes, the interior of each satellite sub-station dome having housing, garden areas, and other outdoor activities facilities, walkways connecting each sub-station dome to adjacent sub-station domes, and a transport system on the surface structure extending along the circumference thereof;

ii) a subsurface base extending downwards from said bottom of said surface structure; and iii) means for anchoring said subsurface base to the seabed;

b) a plurality of land-based terra stations disposed in spaced apart relation on coastal regions; and c) a plurality of subsurface transport tube links interconnecting said aqua stations and said terra stations with one another thereby forming a transport network wherein each said aqua station and said terra station is linked to at least one other station.

2. An aqua-terra planetary transport system as recited in claim 1, wherein said anchoring means is a platform base disposed on the distal end of said subsurface base.

3. An aqua-terra planetary transport system as recited in claim 1, wherein said anchoring means are a plurality of retractable anchors.

4. An aqua-terra planetary transport system as recited in claim 1, wherein each said aqua station further comprises floating landing platforms for aircraft and docking facilities for vessels adjacent said surface structure and connected thereto by a tunnel.

5. An aqua-terra planetary transport system as recited in claim 4, wherein each said transport tube link contains at least one pneumatic tube extending the length thereof for propelling transport cylinders therethrough from one station to the next, each tube having an outer wall containing ballast compartments.

6. An aqua-terra planetary transport system as recited in claim 5, wherein said surface structure includes a retractable dome to expose or enclose said top side of said surface structure.

7. An aqua-terra planetary transport system as recited in claim 6, wherein said central energy core is a central solar base energy core.

8. An aqua-terra planetary transport system as recited in claim 7 in which said surface structure has wind energy sources along the periphery thereof and iris seals for sealing off pressurized areas to prevent water from entering.

* * * * *